US008170734B2

(12) United States Patent
Kaji

(10) Patent No.: US 8,170,734 B2
(45) **Date of Patent: *May 1, 2012**

(54) MARINE VESSEL MANEUVERING SUPPORTING APPARATUS AND MARINE VESSEL INCLUDING THE SAME

(75) Inventor: Hirotaka Kaji, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 471 days.

This patent is subject to a terminal disclaimer.

(21) Appl. No.: 12/493,365

(22) Filed: Jun. 29, 2009

(65) Prior Publication Data

US 2010/0138083 A1 Jun. 3, 2010

(30) Foreign Application Priority Data

Nov. 28, 2008 (JP) ..... 2008-305123

(51) Int. Cl.
*B60L 3/00* (2006.01)

(52) U.S. Cl. ..... 701/21; 114/144 R

(58) Field of Classification Search ..... 701/21; 114/144 R; 440/84, 1
See application file for complete search history.

(56) References Cited

U.S. PATENT DOCUMENTS 6,298,824 B1 * 10/2001 Suhre ..... 123/406.49
6,738,708 B2 * 5/2004 Suzuki et al. ..... 701/110
6,855,020 B2 * 2/2005 Kaji ..... 440/84
6,884,128 B2 * 4/2005 Okuyama et al. ..... 440/1
6,994,046 B2 * 2/2006 Kaji et al. ..... 114/144 R
7,280,904 B2 * 10/2007 Kaji ..... 701/101
7,677,937 B2 * 3/2010 Ishida et al. ..... 440/1
7,736,204 B2 * 6/2010 Kaji ..... 440/1
2007/0017426 A1 1/2007 Kaji et al.

FOREIGN PATENT DOCUMENTS

JP 02-227395 A 9/1990

OTHER PUBLICATIONS

Hirotaka: "Marine Vessel Maneuvering Supporting Apparatus and Marine Vessel Including the Same"; U.S. Appl. No. 12/493,368, filed Jun. 29, 2009.

* cited by examiner

*Primary Examiner* — Gertrude Arthur Jeanglaude
(74) *Attorney, Agent, or Firm* — Keating & Bennett, LLP

(57) ABSTRACT

A marine vessel maneuvering supporting apparatus is used in a marine vessel which includes a propulsion system and a steering mechanism. The marine vessel maneuvering supporting apparatus includes an operational unit, operated by an operator, arranged to control movement and turning of a marine vessel, a target value computing unit having a plurality of computing modes and arranged to compute target values including a target propulsive force for the propulsion system and a target steering angle for the steering mechanism in accordance with an operational input from the operational unit, and a switching unit arranged to switch the computing modes of the target value computing unit.

19 Claims, 11 Drawing Sheets

FIG. 5B

MOVEMENT OF OUTBOARD MOTORS

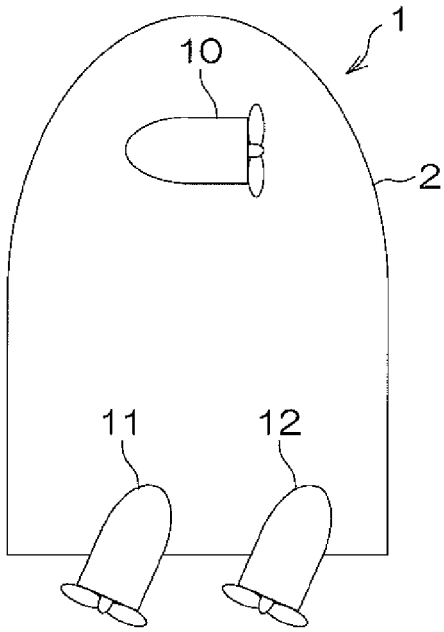

·STEERING IS COUPLED TO RIGHTWARD/LEFTWARD OPERATION OF LEVER.
·PROPELLERS ROTATE FORWARD WHEN LEVER IS INCLINED FORWARD AND ROTATE IN REVERSE WHEN LEVER IS INCLINED IN REVERSE DIRECTION.

OPERATIONS OF LEVER

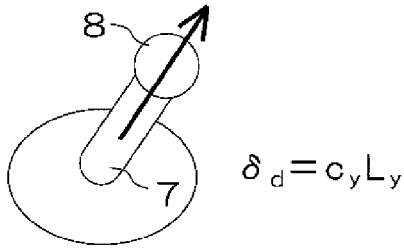

ANGLE OF INCLINATION OF LEVER : STEERING ANGLES OF OUTBOARD MOTORS (ONLY IN RIGHTWARD/ LEFTWARD DIRECTION)

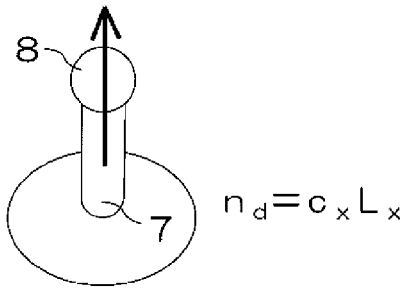

ANGLE OF INCLINATION OF LEVER : TARGET ENGINE SPEED OF OUTBOARD MOTORS (ONLY IN FORWARD/ REVERSE DIRECTION)

FIG. 6

MOVEMENT OF OUTBOARD MOTORS

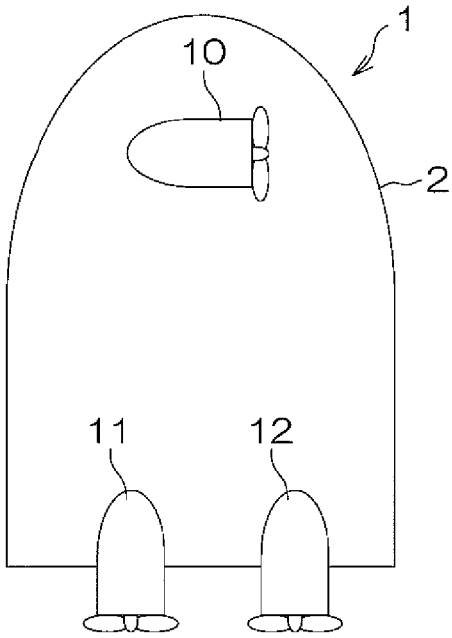

·STEERING DOES NOT MOVE.
·PROPELLERS ARE CONTROLLED TO OUTPUT OPTIMAL THRUST ACCORDING TO DIRECTION AND ANGLE OF LEVER.

OPERATIONS OF LEVER AND KNOB

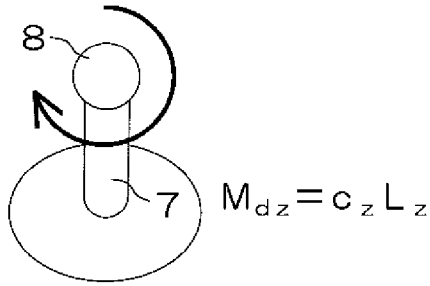

ROTATION OF KNOB : MAGNITUDE OF TORQUE (ROTATION ON THE SPOT)

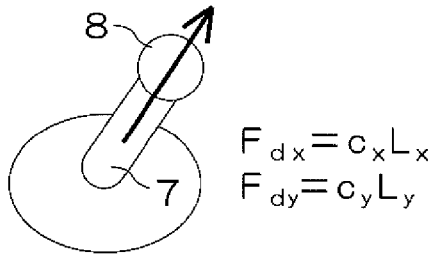

DIRECTION OF INCLINATION OF LEVER : DIRECTION OF THRUST
ANGLE OF INCLINATION OF LEVER : MAGNITUDE OF THRUST (PARALLEL MOVEMENT)

MARINE VESSEL MANEUVERING SUPPORTING APPARATUS AND MARINE VESSEL INCLUDING THE SAME

BACKGROUND OF THE INVENTION

1. Field of the Invention

The present invention relates to a marine vessel, which includes a propulsion system and a steering mechanism, and a marine vessel maneuvering supporting apparatus for such a marine vessel.

2. Description of the Related Art

There has been proposed a marine vessel maneuvering supporting apparatus that can make a marine vessel move laterally without rotating by controlling outputs and steering angles of a pair of outboard motors disposed on a stern of the marine vessel (see, for example, U.S. Patent Application Publication No. 2007/0017426A1). With this marine vessel maneuvering supporting apparatus, a control mode is switched from an ordinary running mode to a marine vessel maneuvering support mode for anchoring when a marine vessel maneuvering support starting button for anchoring is operated. In the marine vessel maneuvering support mode for anchoring, the marine vessel can be made to move laterally in forward, reverse, rightward and leftward directions by operation of a cross button. Marine vessel maneuvering during launching from and docking on shore is thereby facilitated. During ordinary maneuvering other than lateral movement, an operator of the marine vessel operates a steering handle to control the steering angles and operates a remote control lever to control the outboard motor outputs.

The steering angles of the pair of outboard motors are set equal to each other in the ordinary running mode. On the other hand, in the marine vessel maneuvering support mode for anchoring, the propulsive forces and the steering angles of the respective outboard motors are determined such that a direction of a resultant force of the propulsive forces generated by the pair of outboard motors matches an intended direction of movement. The steering angles of the pair of outboard motors thus generally take on different values in the marine vessel maneuvering support mode for anchoring. For example, to make the marine vessel move laterally at a right angle, one propulsive force direction of one of the outboard motors is set obliquely forward and the other propulsive force direction of one of the outboard motors is set obliquely in the reverse direction.

SUMMARY OF THE INVENTION

Near a pier, the operator performs maneuvering for launching from and docking on shore while avoiding other marine vessels close by. Lateral movement maneuvering using the cross button is convenient for this purpose. On the other hand, lateral movement maneuvering is no longer needed when the marine vessel has moved away from the pier and distances to nearby vessels have increased. In the marine vessel maneuvering support mode for anchoring, parallel movement of the marine vessel is achieved by mutual cancellation of the propulsive forces generated by the pair of outboard motors. A high engine speed must thus be maintained even in low speed movement. Thus, in a circumstance in which maneuvering in the ordinary running mode is possible, better energy efficiency is achieved by not using the marine vessel maneuvering support mode for anchoring.

In transitioning from the marine vessel maneuvering support mode for anchoring to the ordinary running mode, an exchange from the lateral movement operational system, which includes the cross button, to the ordinary operational system, which includes the steering handle and the remote control lever, must be performed. Oppositely, when transitioning from the ordinary running mode to the marine vessel maneuvering support mode for anchoring, an exchange from the ordinary operational system to the lateral movement operational system must be performed. Especially, during launching from and docking on shore, the operator is forced to switch the control mode frequently while the marine vessel is moving near a pier. Accordingly, the operator is forced to exchange the operational systems frequently. However, frequent exchange of the operational systems is troublesome.

Also, since both the ordinary operational system and the lateral movement operational system must be prepared, the operational system configuration is complex and the cost is accordingly high. Furthermore, in a small-scale marine vessel, it is not easy to install two types of operational systems in a small vessel maneuvering space.

In order to overcome the problems mentioned above, a preferred embodiment of the present invention provides a marine vessel maneuvering supporting apparatus including an operational unit operated by an operator to control movement and turning of a marine vessel, a target value computing unit having a plurality of computing modes and computing target values including a target propulsive force for a propulsion system and a target steering angle for a steering mechanism, in accordance with an operational input from the operational unit, and a switching unit arranged to switch the computing modes of the target value computing unit.

The operator operates the operational unit to control the movement and turning of the marine vessel. In response, the target value computing unit computes the target values, including the target propulsive force and the target steering angle. The target value computing unit computes, in accordance with the computing mode, the target values corresponding to the operational input from the operational unit. The propulsion system and the steering mechanism are controlled according to the computed target values. The operational input from the operational unit is thus used in common in the computations of the target values in accordance with the plurality of computing modes. The operational unit thus does not have to be changed according to the computing mode. The trouble of exchanging the operational systems can thus be eliminated and the marine vessel maneuvering can be made easy. Moreover, because different operational systems do not have to be equipped according to the respective computing modes, the operational system configuration can be simplified and the cost can be reduced accordingly. Also, the installation space for the operational system can be reduced, thereby enabling the necessary operational system to be equipped readily even in a small-scale marine vessel.

Preferably, a control unit is further included that controls the propulsion system and the steering mechanism according to the target values determined by the target value computing unit. Such a control unit may be disposed in the marine vessel maneuvering supporting apparatus or in the propulsion system and the steering mechanism.

The switching unit may be configured to respond to a predetermined operational input or may be configured to automatically switch the computing mode based on a predetermined switching condition.

The target value computing unit may include a plurality of target value computing units (modules) that compute target values in different modes. In this case, the switching unit may include a selecting unit that selects one target value computing unit from among the plurality of target value computing units. The selecting unit may be a selecting and outputting unit that selects one target value computing unit from among the target value computing units and outputs the computation results of that computing unit. The selecting unit may be a selecting and activating unit that selects and activates one target value computing unit from among the target value computing units.

The marine vessel maneuvering supporting apparatus according to a preferred embodiment of the present invention is applied to a marine vessel that includes a plurality of propulsion systems and a plurality of steering mechanisms, which respectively correspond to the plurality of propulsion systems. In this case, the plurality of computing modes may include a parallel mode and a non-parallel mode. In the parallel mode, the steering angles of the plurality of propulsion systems are set to be (virtually) parallel. In the non-parallel mode, the steering angles of the propulsion systems are set to be non-parallel.

In the parallel mode, the propulsive forces can be applied to the marine vessel efficiently because the steering angles of the propulsion systems are set to be parallel. On the other hand, in the non-parallel mode, the propulsive forces generated by the propulsion systems are mutually cancelled in part because the steering angles of the propulsion systems are set to be non-parallel. In the non-parallel mode, it becomes possible to move the marine vessel laterally in various directions by making use of a balance of the forces generated by the propulsion system. The parallel mode is an ordinary running mode, and the non-parallel mode is a parallel movement mode in which parallel movement of the marine vessel is performed. "Parallel movement" refers to a movement state in which a center (for example, an instantaneous center of rotation) of the marine vessel moves rectilinearly. However, in the parallel movement mode, control may be performed not only such that the marine vessel does not turn but also such that the marine vessel turns as well. Further, running control for keeping the marine vessel at a fixed point against water flow or wind is also realized by the parallel movement mode.

The parallel mode (ordinary running mode) is thus a computing mode suited for circumstances where the marine vessel has departed from a crowded water area near a pier. The non-parallel mode (parallel movement mode) is a computing mode suited for running in a crowded water area near a pier, especially during launching from and docking on shore. In the non-parallel mode, the marine vessel can be made to move in parallel without turning or the marine vessel can be made to move while turning.

The propulsion systems preferably include a pair of propulsion systems that can generate propulsive forces astern. Parallel movement of the marine vessel can be realized by making use of the balance of the propulsive forces generated by the pair of propulsion systems.

In a preferred embodiment, the switching unit switches the computing mode of the target value computing unit according to a state of the marine vessel. By this configuration, an operation for switching the computing mode is unnecessary because the computing mode is switched automatically according to the state of the marine vessel. Marine vessel maneuvering is thereby made easier.

The state of the marine vessel may include at least one of either an operation state of the marine vessel or an environment surrounding the marine vessel. With this configuration, the computing mode is switched according to the operation state of the marine vessel or the environment surrounding the marine vessel. Thereby, a suitable computing mode is automatically selected and a comfortable marine vessel maneuvering can be performed. The operation state of the marine vessel is, for example, a speed of the marine vessel or an output (for example, a rotation speed) of the propulsion system. The environment surrounding the marine vessel is, for example, a current position of the marine vessel or presence or non-presence of an obstacle in the surroundings of the marine vessel.

The state of the marine vessel may include the speed of the marine vessel. In this case, the switching unit preferably switches the computing mode of the target value computing unit according to the speed of the marine vessel. With this configuration, the computing mode can be switched automatically according to the speed of the marine vessel.

More specifically, the switching unit may be configured to compare the speed of the marine vessel and a predetermined speed threshold and switch the computing mode of the target value computing unit according to the comparison result. With this configuration, the computing mode is switched according to the result of comparing the speed of the marine vessel and the speed threshold. For example, the non-parallel mode is selected in low-speed running, and the parallel mode is selected in high-speed running. The non-parallel mode is thereby set during launching from and docking on shore, and maneuvering for launching from and docking on shore is thus facilitated. When running at a high speed in a location away from a crowded area near a pier, the parallel mode is set and the propulsive force generated by the propulsion system can thus be used efficiently.

In addition, an equivalent speed threshold may be applied to the speed of the marine vessel in a forward drive direction and the speed of the marine vessel in a reverse drive direction, or different speed thresholds may be applied. For example, the speed threshold applied to the marine vessel speed in the forward drive direction may be set higher than the speed threshold applied to the marine vessel speed in the reverse drive direction. A resistance that the marine vessel receives during running is relatively small during forward drive and is relatively large during reverse drive. Thus, by setting the speed threshold applied to the marine vessel speed in the reverse drive direction to be relatively low, mode switching can be made to occur at an equivalent operational input during forward drive and reverse drive. An uncomfortable feeling can thereby be prevented.

Further, a first speed threshold may be applied to judge switching from the non-parallel mode to the parallel mode and a second speed threshold, differing from the first speed threshold, may be applied to judge switching from the parallel mode to the non-parallel mode. For example, the first speed threshold may be set to a higher value than the second speed threshold. A hysteresis can thereby be applied to the switching of the computing mode, and frequent computing mode transition can be prevented.

In a preferred embodiment, the state of the marine vessel includes at least one of either position information of the marine vessel or obstacle information concerning presence or non-presence of an obstacle in the surroundings of the marine vessel.

With this configuration, the computing mode is switched according to the position of the marine vessel or the presence or non-presence of an obstacle in the surroundings of the marine vessel. For example, the non-parallel mode is selected when the position of the marine vessel is within a predetermined water area (for example, a vicinity of a pier), and the parallel mode is selected when the marine vessel is positioned outside the predetermined water area. Further, the non-parallel mode is selected when an obstacle exists in a region within a predetermined distance in the surroundings of the marine vessel, and the parallel mode is selected when an obstacle does not exist in the region.

A marine vessel maneuvering supporting apparatus according to a preferred embodiment further includes an obstacle determining unit receiving a detection signal from an obstacle sensor that detects the presence or non-presence of an obstacle in the surroundings of the marine vessel and thereby determining the presence or non-presence of the obstacle in the surroundings of the marine vessel. Preferably in this case, the switching unit switches the computing mode of the target value computing unit according to the determination result of the obstacle determining unit.

With this configuration, an obstacle is detected by the obstacle sensor and the computing mode is switched according to the detection result. More specifically, the non-parallel mode is selected when an obstacle is detected in the region within the predetermined distance in the surroundings of the marine vessel. Marine vessel maneuvering for avoiding the obstacle can thereby be performed easily.

As the obstacle sensor, a distance measuring sensor, such as a laser sensor, an ultrasonic sensor, etc., may preferably be used.

The operational unit may include an inclinable lever and an input detecting unit having an inclination detecting unit that detects the inclination of the lever.

With this configuration, an operation for controlling the movement and turning of the marine vessel can be performed by inclining the lever. The lever may be configured to be operated by hand or by foot of the operator.

Besides a lever, a pedal or other operating member may be applied as the operational unit.

The lever may be capable of inclination in forward and reverse directions. The operational unit may further include a rotatable rotation operational section. The input detecting unit may further include a rotation detecting unit that detects a rotation operation of the rotation operational section.

With this configuration, for example, an operation for controlling a direction of the propulsive force and a magnitude of the propulsive force can be performed by inclining the lever in the forward or reverse direction, and a turning operation can be performed by rotating the rotation operational section.

The rotation operational section may be disposed integral to the lever and be configured to be rotatable around an axis direction of the lever. A joystick type operational unit can thereby be configured. The rotation operational section may be configured such that the lever rotates around an axial line thereof, or may be configured such that a rotation operational element that rotates in a relative manner around an axial line of the lever is coupled to the lever. As a matter of course, the rotation operational section may be configured separately from the lever.

The plurality of computing modes may include a first mode (ordinary running mode, parallel mode) and a second mode (parallel-movement mode, non-parallel mode) and the target values may be computed with the inclination operation of the lever being associated with adjustment of the propulsion system output and the rotation operation of the rotation operational section being associated with adjustment of the steering angle of the steering mechanism. In the second mode, the target values may be computed with the inclination direction of the lever being associated with adjustment of a heading direction of the marine vessel and the rotation operation of the rotation operational section being associated with adjustment of turning of the marine vessel.

By this configuration, in the first mode, the propulsive force can be adjusted according to the inclination of the lever, and the steering angle can be adjusted according to the rotational operation of the rotation operational section. In the second mode, on the other hand, the heading direction of the marine vessel can be set according to the inclination of the lever, and the turning (for example, an angular speed) of the marine vessel can be adjusted by the rotation operation of the rotation operational section. The inclination of the lever and the rotation of the rotation operational section can thus be made to serve different roles in the first and second modes.

The lever may be capable of inclination in rightward and leftward directions as well as in forward and reverse directions. In this case, the computing modes may include a first mode (ordinary running mode, parallel mode), in which the target values are computed with the forward/reverse direction inclination operation of the lever being associated with the adjustment of the propulsion system output and the rightward/leftward direction inclination operation of the lever being associated with the adjustment of the steering angle of the steering mechanism. The computing mode may further include a second mode (parallel-movement mode, non-parallel mode), in which the target values are computed with the inclination direction of the lever being associated with the adjustment of the heading direction of the marine vessel.

With this configuration, the output of the propulsion system and the steering angle can be adjusted by inclining the lever in the forward, reverse, rightward, or leftward direction. Specifically, in the first mode, the propulsive force can be adjusted by inclining the lever in the forward or reverse direction, and the steering angle can be adjusted by inclining the lever in the rightward or leftward direction. In the second mode, the propulsive force and the steering angle are determined with the inclination direction of the lever being the target heading direction of the marine vessel. The lever can thus be used in common in the first and second modes.

Further in the second mode, the target values may be computed with the rotation operation of the rotation operational section being associated with the adjustment of the turning of the marine vessel.

In a marine vessel maneuvering supporting apparatus according to a preferred embodiment, the computing mode is switched under a condition that an operational input from the operational unit is not being made.

With this configuration, an uncomfortable feeling felt by a passenger due to switching of the computing mode can be prevented because the computing mode is switched when an operational input from the operational unit is not being made. That an "operational input is not being made" includes an operation in an operation range (dead band) in which a propulsive force is not generated from the propulsion system.

A preferred embodiment of the present invention provides a marine vessel that includes a hull, a propulsion system, a steering mechanism attached to the hull, and the above-described marine vessel maneuvering supporting apparatus that computes the target values for the propulsion system and the steering mechanism.

With this configuration, an operational system in common can be used for a plurality of computing modes. Maneuvering of the marine vessel is made easy because the operational system does not have to be exchanged according to the computing modes. There is also no need to prepare a plurality of operational systems according to the plurality of computing modes, whereby the configuration of the operational system can be simplified, and the installation space thereof can be reduced.

The marine vessel may preferably be a relatively small-scale marine vessel such as a cruiser, a fishing boat, a water jet or a watercraft, for example.

The propulsion system included in the marine vessel may preferably be in the form of an outboard motor, an inboard/outboard motor (a stern drive or an inboard motor/outboard drive), an inboard motor, a water jet drive, or other suitable motor or drive, for example. The outboard motor includes a propulsion unit provided outboard of the vessel and having a motor (engine or electric motor) and a propulsive force generating member (propeller), and a steering mechanism, which horizontally turns the entire propulsion unit with respect to the hull. The inboard/outboard motor includes a motor provided inboard of the vessel, and a drive unit provided outboard and having a propulsive force generating member and a steering mechanism. The inboard motor includes a motor and a drive unit incorporated in the hull, and a propeller shaft extending outboard from the drive unit. In this case, a steering mechanism is separately provided. The water jet drive has a configuration such that water sucked in from the bottom of the marine vessel is accelerated by a pump and ejected from an ejection nozzle provided at the stern of the marine vessel to provide a propulsive force. In this case, the steering mechanism includes the ejection nozzle and a mechanism for turning the ejection nozzle along a horizontal plane.

Other elements, features, steps, characteristics and advantages of the present invention will become more apparent from the following detailed description of the preferred embodiments with reference to the attached drawings.

BRIEF DESCRIPTION OF THE DRAWINGS

FIG. 5B is a diagram for explaining another operation example concerning a relationship between operator's operations of the lever and actions of the outboard motors in the ordinary running mode.

FIG. 6 is a diagram for explaining operator's operations of the lever and actions of a bow thruster and the outboard motors in a parallel movement mode.

DETAILED DESCRIPTION OF THE PREFERRED EMBODIMENTS

Figure 1:
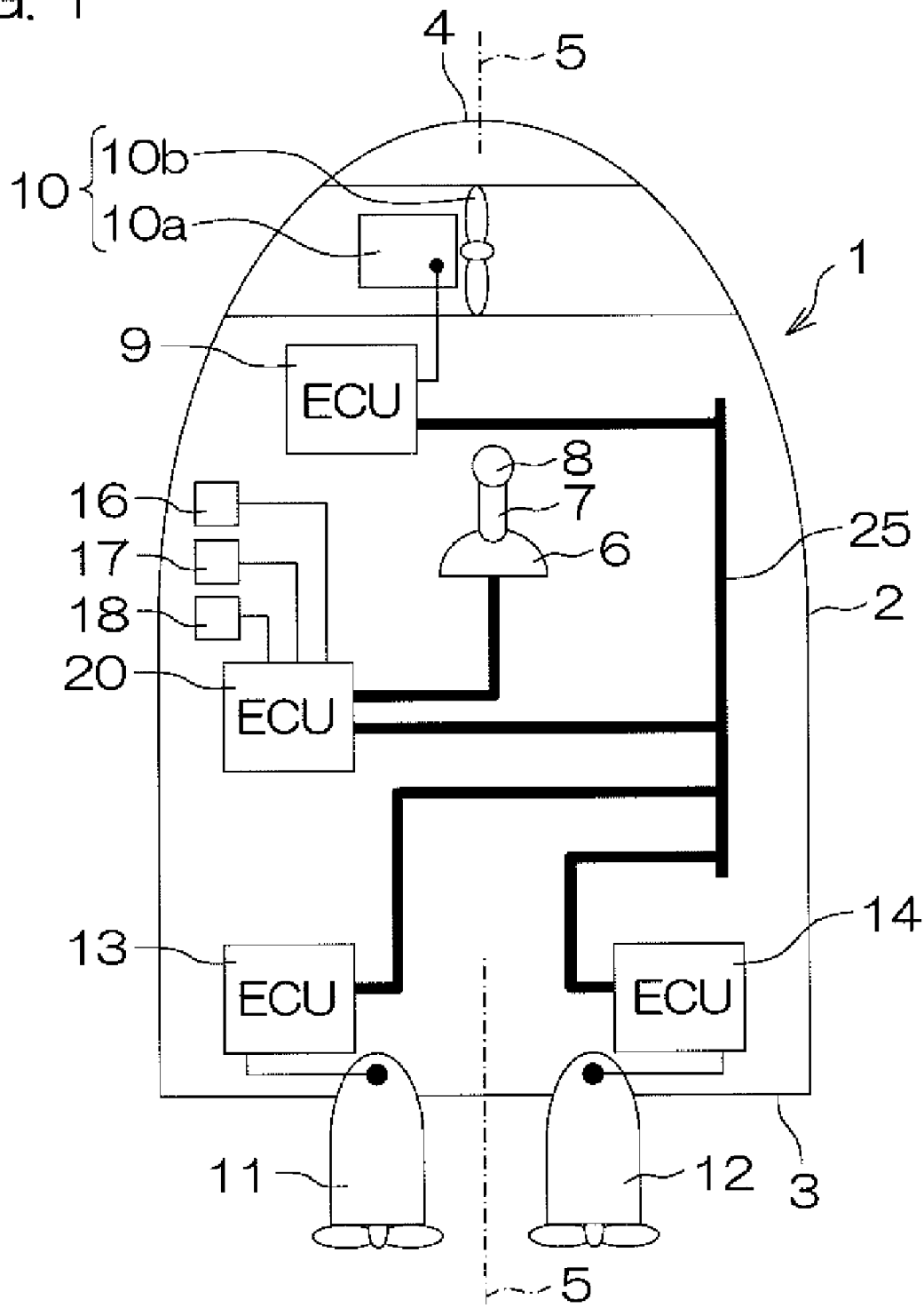
FIG. 1 is a schematic diagram for explaining a configuration of a marine vessel according to a preferred embodiment of the present invention.

FIG. 1 is a schematic diagram for explaining a configuration of a marine vessel 1 according to one preferred embodiment of the present invention. The marine vessel 1 preferably is a relatively small-scale marine vessel, such as a cruiser or a boat, for example. A single bow thruster 10 and a pair of outboard motors 11 and 12 are attached to a hull 2 of the marine vessel 1. The outboard motors 11 and 12 are attached to a stern (transom) 3 of the hull 2. The pair of outboard motors 11 and 12 are attached at right/left symmetrical positions with respect to a central line 5 that passes through the stern 3 and a bow 4 of the hull 2. That is, one outboard motor 11 is attached to a portside rear portion of the hull 2 and the other outboard motor 12 is attached to a starboard side rear portion of the hull 2. Thus, in the following description, in cases where the outboard motors are to be distinguished, the motors shall be referred to as the "portside outboard motor 11" and the "starboard side outboard motor 12." The bow thruster 10 is attached near the bow 4 of the hull 2. The bow thruster 10 is a propulsion unit that generates a propulsion force in a rightward/leftward direction that intersects the central line 5. More specifically, the bow thruster 10 includes an electric motor 10*a* and a propeller 10*b* that is driven to rotate forward or in reverse by the electric motor 10*a*. The propulsive force generated by the propeller 10*b* is aligned along a horizontal direction (rightward/leftward direction) that intersects (is perpendicular or substantially perpendicular to) the central line of the marine vessel 1. In the following description, the bow thruster 10 and the outboard motors 11 and 12 may be referred to collectively as "propulsion systems 10 to 12," etc.

An electronic control unit (ECU) 9, which controls a rotation direction and a rotation speed of the electric motor 10*a*, is incorporated in the bow thruster 10. Electronic control units 13 and 14 (hereinafter referred to as "outboard motor ECU 13" and "outboard motor ECU 14") are incorporated in the portside outboard motor 11 and the starboard side outboard motor 12, respectively. However in FIG. 1, the ECUs 9, 13, and 14 are illustrated as being separate from main body portions of the propulsion systems 10 to 12 for the sake of convenience.

A control console 6 for marine vessel maneuvering is disposed at a control compartment of the hull 2. The control console 6 includes a joystick type lever 7. A knob 8, capable of being rotatably operated around an axial line of the lever 7, is disposed at a head portion of the lever 7. The lever 7 can be inclined freely in forward, reverse, rightward, and leftward directions. An inclination amount in the forward/reverse direction and an inclination amount in the rightward/leftward direction are respectively detected by sensors (potentiometers or other position sensors). A rotation operation amount of the knob 8 is detected by another sensor (potentiometer or other position sensor).

Signals expressing the inclination amounts of the lever 7 and the rotation operation amount of the knob 8 are to be input into a marine vessel running controlling apparatus 20.

The marine vessel running controlling apparatus 20 preferably is an electronic control unit (ECU) that includes a microcomputer. The marine vessel running controlling apparatus 20 performs communication with the ECUs 9, 13, and 14 via a LAN (local area network, hereinafter referred to as "inboard LAN") 25 installed inside the hull 2. More specifically, the marine vessel running controlling apparatus 20 acquires rotation speeds of engines included in the outboard motors 11 and 12 from the outboard motor ECUs 13 and 14. In addition, the marine vessel running controlling apparatus 20 is configured to provide data, expressing a target shift position (forward drive, neutral, reverse drive), a target engine speed, and a target steering angle, to the outboard motor ECUs 13 and 14. The marine vessel running controlling apparatus 20 acquires rotation speed information of the propeller 10*b* from the ECU 9 corresponding to the bow thruster 10. The marine vessel running controlling apparatus 20 provides a target rotation direction and a target rotation speed of the electric motor 10*a* to the ECU 9 corresponding to the bow thruster 10.

Also, output signals from a speed sensor 16, a position detecting apparatus 17, and an obstacle sensor 18 are input into the marine vessel running controlling apparatus 20. The speed sensor 16 detects a forward drive speed and a reverse drive speed of the marine vessel 1 and outputs a speed signal. The speed sensor 16 may detect water speeds or may detect ground speeds. Specifically, the speed sensor 16 can be configured using a Pilot tube. The position detecting apparatus 17 generates a current position signal of the marine vessel 1 and can be configured by a GPS (global positioning system) receiver that receives radio waves from GPS satellites to generate current position information. The obstacle sensor 18 detects obstacles in the areas surrounding the marine vessel 1 and can be configured by a distance measuring apparatus such as a laser radar or an ultrasonic sensor.

The marine vessel running controlling apparatus 20 performs control operations in accordance with a plurality of control modes including an ordinary running mode and a parallel movement mode (marine vessel maneuvering support mode for anchoring).

In the ordinary running mode, the marine vessel running controlling apparatus 20 sets the target steering angles of the outboard motors 11 and 12 to equal values in accordance with one of either a rightward/leftward inclination operation of the lever 7 or a rotation operation of the knob 8. The outboard motors 11 and 12 thus generate propulsive forces in mutually parallel directions. The marine vessel running controlling apparatus 20 also sets the target engine speeds and the target shift positions of the respective outboard motors 11 and 12 in accordance with a forward/reverse inclination operation amount of the lever 7. The bow thruster 10 is controlled to be in a stopped state.

In the parallel movement mode, the marine vessel running controlling apparatus 20 sets the target shift positions, the target engine speeds, and the target steering angles of the outboard motors 11 and 12 such that the marine vessel 1 undergoes parallel movement in the inclination direction of the lever 7, and such that the marine vessel 1 turns at an angular speed that is in accordance with the rotation operation amount of the knob 8. The marine vessel running controlling apparatus 20 also sets the target rotation direction and the target rotation speed of the electric motor 10*a* of the bow thruster 10. In the parallel movement mode, the directions of propulsive forces generated by the portside and starboard side outboard motors 11 and 12 are generally non-parallel.

Figure 2:
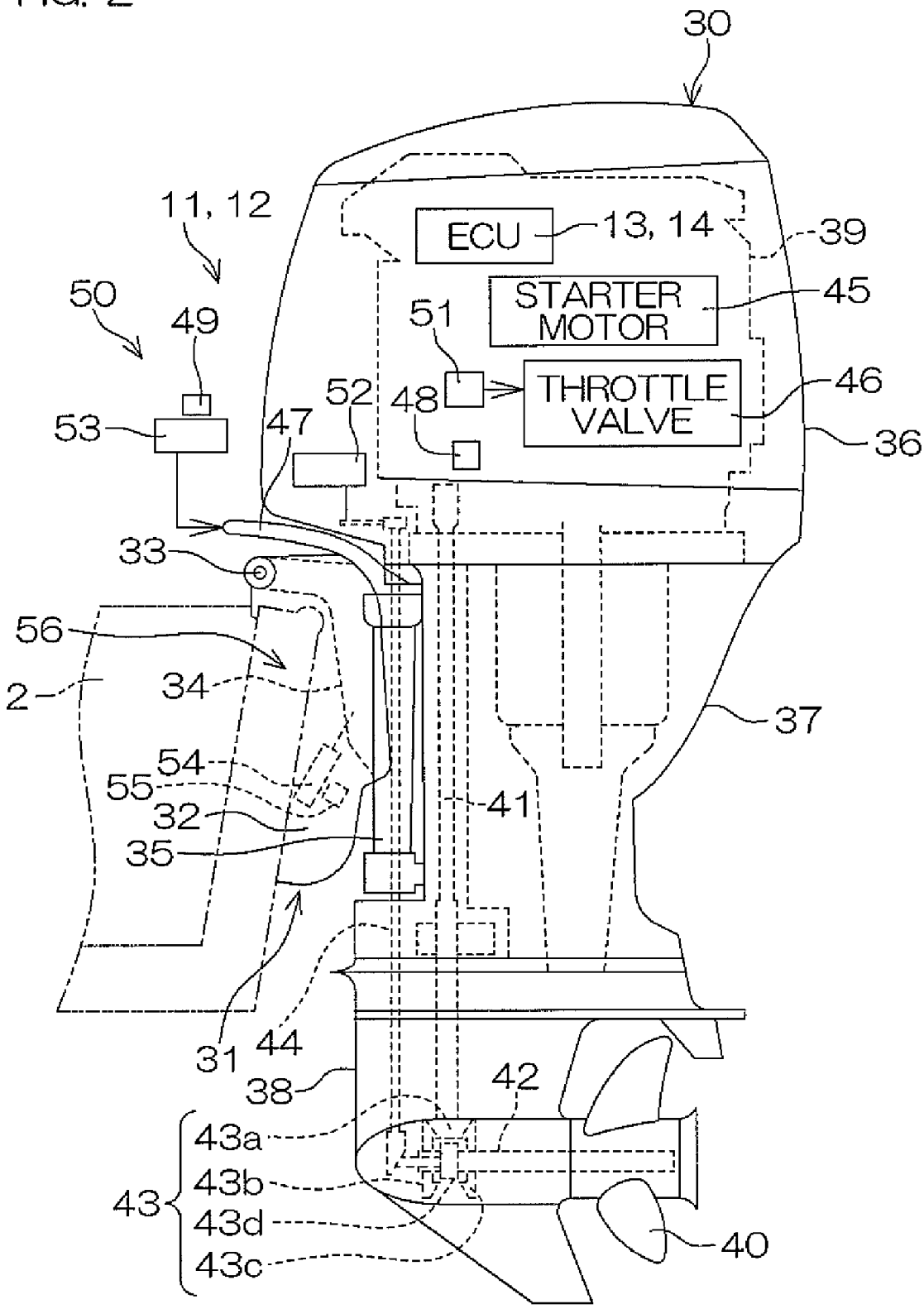
FIG. 2 is a schematic sectional view for explaining a configuration of an outboard motor.

FIG. 2 is a schematic sectional view for explaining a configuration in common to the outboard motors 11 and 12. Each of the outboard motors 11 and 12 includes a propulsion unit 30 and an attachment mechanism 31 for attaching the propulsion unit 30 to the hull 2. The attachment mechanism 31 includes a clamp bracket 32 detachably fixed to the transom of the hull 2, and a swivel bracket 34 connected to the clamp bracket 32 pivotally around a tilt shaft 33 as a horizontal pivot axis. The propulsion unit 30 is attached to the swivel bracket 34 pivotally around a steering shaft 35. The steering angle (which is equivalent to an angle defined by the direction of the propulsive force with respect to the center line 5 of the hull 2) is thus changed by pivoting the propulsion unit 30 around the steering shaft 35. Further, a trim angle of the propulsion unit 30 is changed by pivoting the swivel bracket 34 around the tilt shaft 33. The trim angle corresponds to an attachment angle of each of the outboard motors 11 and 12 with respect to the hull 2.

The propulsion unit 30 has a housing which includes a top cowling 36, an upper case 37, and a lower case 38. An engine 39 is provided as a drive source in the top cowling 36 with an axis line of a crank shaft thereof extending vertically. A drive shaft 41 for power transmission is coupled to a lower end of the crank shaft of the engine 39 and vertically extends through the upper case 37 into the lower case 38.

A propeller 40, serving as a propulsive force generating member, is rotatably attached to a lower rear portion of the lower case 38. A propeller shaft 42, which is a rotation shaft of the propeller 40, extends horizontally in the lower case 38. The rotation of the drive shaft 41 is transmitted to the propeller shaft 42 via a shift mechanism 43 that serves as a clutch mechanism.

The shift mechanism 43 includes a beveled drive gear 43*a* fixed to a lower end of the drive shaft 41, a beveled forward drive gear 43*b* rotatably provided on the propeller shaft 42, a beveled reverse drive gear 43*c* rotatably provided on the propeller shaft 42, and a dog clutch 43*d* provided between the forward drive gear 43*b* and the reverse drive gear 43*c*.

The forward drive gear 43*b* is meshed with the drive gear 43*a* from a forward side, and the reverse drive gear 43*c* is meshed with the drive gear 43*a* from a reverse side. Therefore, the forward drive gear 43*b* and the reverse drive gear 43*c* rotate in opposite directions when the drive gear 43*a* rotates.

On the other hand, the dog clutch 43*d* is in spline engagement with the propeller shaft 42. That is, although the dog clutch 43*d* is axially slidable with respect to the propeller shaft 42, it is not rotatable relative to the propeller shaft 42 and rotates together with the propeller shaft 42.

A shift rod 44, which extends vertically parallel to the drive shaft 41, rotates around its axis to make the dog clutch 43*d* slide along the propeller shaft 42. The shift position of the dog clutch 43*d* is thereby controlled to be set at a forward drive position at which it is engaged with the forward drive gear 43*b*, at a reverse drive position at which it is engaged with the reverse drive gear 43*c*, or at a neutral position at which it is not engaged with either the forward drive gear 43*b* or the reverse drive gear 43*c*.

When the dog clutch 43*d* is in the forward drive position, the rotation of the forward drive gear 43*b* is transmitted to the propeller shaft 42 via the dog clutch 43*d*. Thus, the propeller 40 is rotated in one direction (forward drive direction) to generate a propulsive force in a direction for moving the hull 2 forward. On the other hand, when the dog clutch 43*d* is in the reverse drive position, the rotation of the reverse drive gear 43*c* is transmitted to the propeller shaft via the dog clutch 43*d*. The reverse drive gear 43*c* is rotated in a direction opposite to that of the forward drive gear 43*b*. Therefore, the propeller 40 is rotated in an opposite direction (reverse drive direction) to generate a propulsive force in a direction for moving the hull 2 in reverse. When the dog clutch 43*d* is in the neutral position, the rotation of the drive shaft 41 is not transmitted to the propeller shaft 42. That is, the transmission pathway of a driving force between the engine 39 and the propeller 40 is blocked such that no propulsive force is generated in either of the forward and reverse directions.

In association with the engine 39, a starter motor 45 is provided for starting the engine 39. The starter motor 45 is controlled by the corresponding outboard motor ECU 13 or 14. The propulsion unit 30 further includes a throttle actuator 51 for actuating a throttle valve 46 of the engine 39 in order to change the throttle opening degree to change the intake air amount of the engine 39. The throttle actuator may be an electric motor. The operation of the throttle actuator is controlled by the corresponding outboard motor ECU 13 or 14.

Furthermore, an engine speed detecting unit 48 is arranged to detect the rotation speed of the engine 39 by detection of the rotation of the crankshaft.

A shift actuator 52 (clutch actuator) is arranged to change the shift position of the dog clutch 43*d*. The shift actuator 52 preferably includes, for example, an electric motor, and the operation thereof is controlled by the corresponding outboard motor ECU 13 or 14.

Further, a steering actuator 53 which is controlled by the corresponding outboard motor ECU 13 or 14, is connected to the steering rod 47 fixed to the propulsion unit 30. For example, the steering actuator 53 may include a DC servo motor and a speed reducer. By driving the steering actuator 53, the propulsion unit 30 is pivoted around the steering shaft 35 for the steering operation. The steering actuator 53, the steering rod 47 and the steering shaft 35 define a steering mechanism 50 (electric steering apparatus). The steering mechanism 50 includes a steering angle sensor 49 arranged to detect the steering angle. The steering angle sensor 49 preferably includes, for example, a potentiometer.

A trim actuator (tilt trim actuators) 54, which includes, for example, a hydraulic cylinder and is controlled by the corresponding outboard motor ECU 13 or 14, is provided between the clamp bracket 32 and the swivel bracket 34. The trim actuator 54 pivots the propulsion unit 30 around the tilt shaft 33 by pivoting the swivel bracket 34 around the tilt shaft 33. A trim mechanism 56 is arranged to change the trim angle of the propulsion unit 30. The trim angle is detected by a trim angle sensor 55. An output signal of the trim angle sensor 55 is input into the corresponding outboard motor ECU 13 or 14.

Figure 3A:
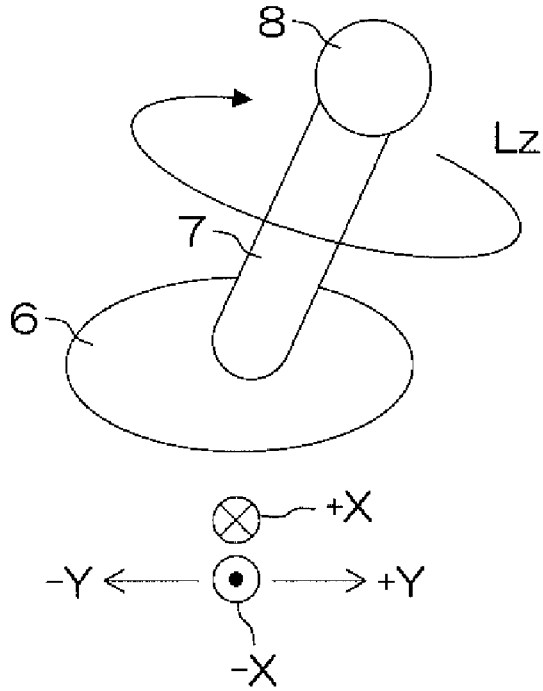
FIG. 3A is an enlarged schematic side view of a configuration of a lever and a knob.
Figure 3B:
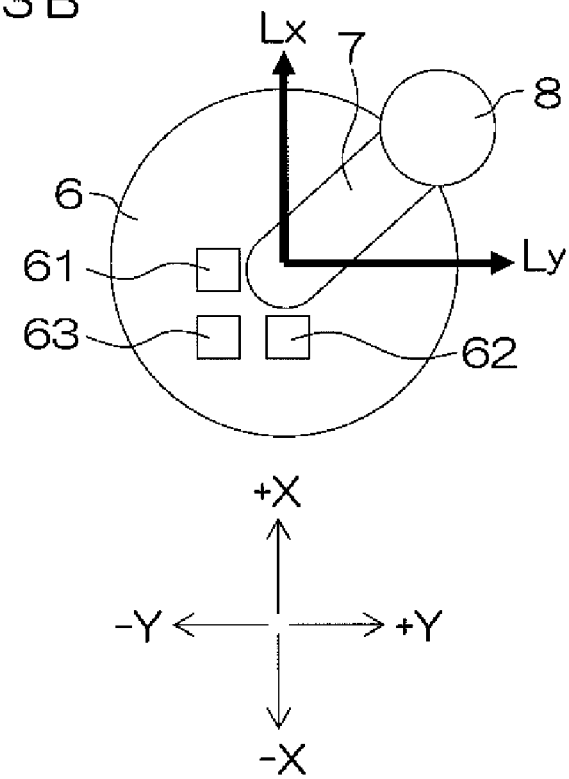
FIG. 3B is a plan view thereof.

FIG. 3A is an enlarged schematic side view of the configuration of the lever 7 and the knob 8, and FIG. 3B is a plan view thereof. The direction extending from the top surface to the bottom surface of the paper in FIG. 3A, that is, the direction extending from the lower side to the upper side of the paper in FIG. 3B corresponds to the forward drive direction +X of the marine vessel 1. The reverse drive direction −X, the rightward direction +Y, and the leftward direction −Y are indicated based on the forward drive direction +X in the respective figures.

The lever 7 is protruded from the control console 6 and is freely inclinable in any direction. A substantially spherical knob 8 is attached to a free end of the lever 7.

In the neutral position, the lever 7 is perpendicular or substantially perpendicular to the surface of the control console 6. When the operator holds the knob 8 and inclines the lever 7 in a desired direction from the neutral position, the marine vessel running controlling apparatus 20 controls the propulsive forces and directions thereof of the bow thruster 10 and the outboard motors 11 and 12 based on the inclination position (inclination direction and inclination amount) of the lever 7. The operator can thus control the heading speed and heading direction of the marine vessel 1 by operating the lever 7.

An inclination amount $L_x$ of the lever 7 in the forward/reverse direction X (+X, −X) is detected by a first position sensor 61, disposed in the control console 6, and is supplied to the marine vessel running controlling apparatus 20. Likewise, an inclination amount $L_y$ of the lever 7 in the rightward/leftward direction Y (+Y, −Y) is detected by a second position sensor 62, provided in the control console 6, and is supplied to the marine vessel running controlling apparatus 20. Further, a third position sensor 63 arranged to detect the rotation operation position (rotation operation direction and rotation operation amount) $L_z$ of the knob 8 is disposed in the control console 6, and an output signal thereof is supplied to the marine vessel running controlling apparatus 20. The first to third position sensors 61 to 63 may preferably include potentiometers.

When the lever 7 is inclined forward by a predetermined amount from the neutral position, the inclination position of the lever 7 is at a forward drive shift-in position. That is, when, in the ordinary running mode, the lever 7 is inclined forward to the forward drive shift-in position, the marine vessel running controlling apparatus 20 changes the target shift position of each of the outboard motors 11 and 12 from the neutral position to the forward drive position. When the lever 7 is inclined in the reverse direction by a predetermined amount from the neutral position, the inclination position of the lever 7 is at a reverse drive shift-in position. That is, when, in the ordinary running mode, the lever 7 is inclined in the reverse direction to the reverse drive shift-in position, the marine vessel running controlling apparatus 20 changes the target shift position of each of the outboard motors 11 and 12 from the neutral position to the reverse drive position. When the lever 7 is positioned in between the forward drive shift-in position and the reverse drive shift-in position, the marine vessel running controlling apparatus 20 sets the target shift position to the neutral position and sets the target engine speed to an idle speed. In this state, propulsive forces are not generated from the outboard motors 11 and 12 because the driving force of each engine 39 is not transmitted to the propeller 40.

When the lever 7 is inclined further forward beyond the forward drive shift-in position, the marine vessel running controlling apparatus 20 increases the target engine speed as the inclination amount is increased. Likewise, when the lever 7 is inclined further in the reverse direction beyond the reverse drive shift-in position, the marine vessel running controlling apparatus 20 increases the target engine speed as the inclination amount is increased. The magnitude of the propulsive forces in the forward drive direction or the reverse drive direction that are generated by the outboard motors 11 and 12 can thereby be adjusted.

Meanwhile, in the ordinary running mode, the marine vessel running controlling apparatus 20 sets the target steering angle according to the rotation operation position of the knob 8. The steering mechanisms 50 of the outboard motors 11 and 12 are controlled according to the target steering angle. Steering control can thus be performed by operation of the knob 8.

Figure 4:
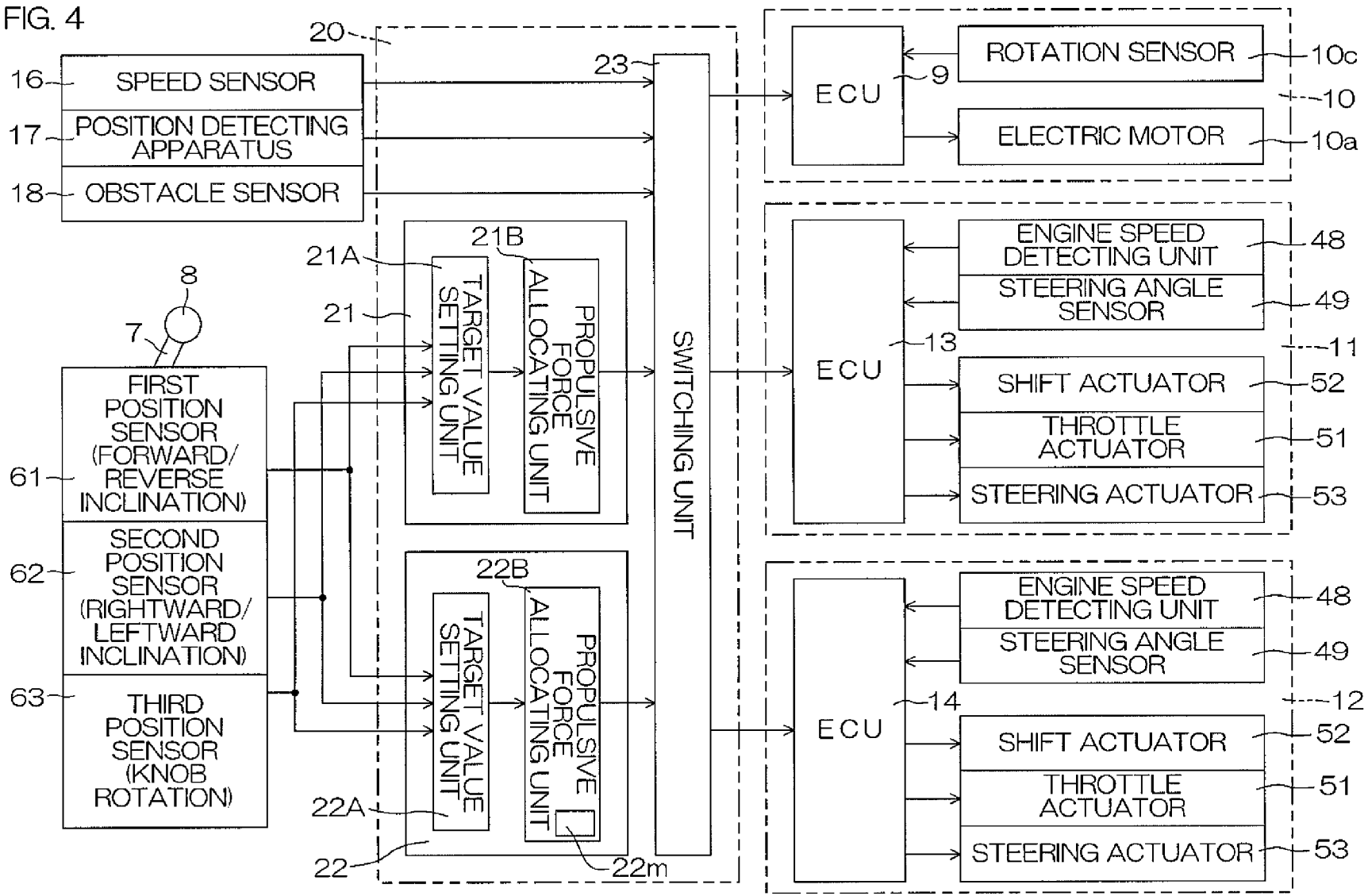
FIG. 4 is a block diagram for explaining an electrical configuration of principal portions of the marine vessel.

FIG. 4 is a block diagram for explaining an electrical configuration of principal portions of the marine vessel 1. The marine vessel running controlling apparatus 20 includes a microcomputer, which includes a CPU (central processing unit) and a memory, and performs predetermined software-based processes to function virtually as a plurality of functional processing units. The functional processing units include first and second target value computing sections 21 and 22, and a switching unit 23. The first target value computing section 21 computes target values for the ordinary running mode. The second target value computing section 21 computes target values for the parallel movement mode. The switching unit 23 selects, in accordance with the state of the marine vessel 1, the target values computed by either the first or second target value computing section 21 or 22. The target values selected by the switching unit 23 are provided to the ECU 9 for the bow thruster 10, the outboard motor ECU 13 for the portside outboard motor 11, and the outboard motor ECU 14 for the starboard side outboard motor 12.

The bow thruster 10 includes the electric motor 10*a*, which drives the propeller 10*b*, and a rotation sensor 10*c*, which detects the rotation speed of the electric motor 10*a* (that is, the rotation speed of the propeller 10*b*). The marine vessel running controlling apparatus 20 provides the target values, including the target rotation direction and the target rotation speed, to the ECU 9. The ECU 9 uses the rotation signal fed back from the rotation sensor 10*c* to perform feedback control of the electric motor 10*a* based on the target rotation direction and the target rotation speed.

The ECUs 13 and 14 of the outboard motors 11 and 12 control the corresponding throttle actuators 51, shift actuators 52, and steering actuators 53 in accordance with the target values provided by the marine vessel running controlling apparatus 20. The target values in this case include the target shift position, the target engine speed, and the target steering angle. The engine speeds detected by the engine speed detecting units 48 and the steering angles detected by the steering angle sensors 49 are input into the ECUs 13 and 14. Each of the ECUs 13 and 14 controls the throttle actuator 51 such that the engine speed detected by the engine speed detecting unit 48 matches the target engine speed. Each of the ECUs 13 and 14 also controls (for example, performs PD (proportional differential) control of) the steering actuator 53 such that the steering angle detected by the steering angle sensor 49 matches the target steering angle.

The first target value computing section 21 includes a target value setting unit 21A and a propulsive force allocating unit 21B. The target value setting unit 21A generates the target shift position and the target engine speed according to the operation of the lever 7 in the forward/reverse direction. The target value setting unit 21A also generates the target steering angle according to the rotation operation of the knob 8. As another operation example, the target value setting unit 21A may be configured to set the target shift position and the target engine speed according to the operation of the lever 7 in the forward/reverse direction and set the target steering angle according to the operation of the lever 7 in the rightward/leftward direction. The propulsive force allocating unit 21B allocates the target values (target shift position, target engine speed, and target steering angle), generated by the target value setting unit 21A, among the outboard motor ECUs 13 and 14 corresponding to the portside and starboard side outboard motors 11 and 12. These target values are equal between the portside and starboard side outboard motors 11 and 12. In regard to the electric motor 10*a* of the bow thruster 10, the propulsive force allocating unit 21B sets the target rotation speed thereof to zero.

The target value setting unit 21A generates the target shift position and the target engine speed in accordance with the inclination amount of the lever 7 in the forward/reverse direction. More specifically, when the inclination amount of the lever 7 in the forward direction is not less than a value corresponding to the forward drive shift-in position, the target value setting unit 21A sets the target shift position to the forward drive position. When the lever 7 is inclined further forward beyond the forward drive shift-in position, the target value setting unit 21A sets a higher target engine speed the larger the inclination amount. Likewise, when the inclination amount of the lever 7 in the reverse direction is not less than a value corresponding to the reverse drive shift-in position, the target value setting unit 21A sets the target shift position to the reverse drive position. When the lever 7 is inclined further in the reverse direction beyond the reverse drive shift-in position, the target value setting unit 21A sets a higher target engine speed the larger the inclination amount. When the inclination position of the lever 7 in the forward/reverse direction does not reach either of the forward drive shift-in position and the reverse drive shift-in position, the target value setting unit 21A sets the target shift position to the neutral position. Further, when the inclination position of the lever 7 is within a range between the forward drive shift-in position and the reverse drive shift-in position, the target value setting unit 21A sets the target engine speed to the idle speed.

The target value setting unit 21A sets the target steering angle according to the rotation operation amount and the rotation direction of the knob 8. Specifically, in response to a rotation operation of the knob 8 in the rightward direction, the target steering angle is set to that for rightward turning and the absolute value (deflection angle from a neutral position) thereof is set higher the larger the rotation operation amount from a neutral position. Likewise, in response to a rotation operation of the knob 8 in the leftward direction, the target steering angle is set to that for leftward turning and the absolute value thereof is set higher the larger the rotation operation amount from the neutral position.

In the case of using the rightward and leftward inclination of the lever 7 to set the target steering angle, the target value setting unit 21A sets a target steering angle for rightward turning in response to an inclination operation of the lever 7 in the rightward direction. Likewise, the target value setting unit 21A sets a target steering angle for leftward turning in response to an inclination operation of the lever 7 in the leftward direction. In both cases, the absolute value (deflection angle from the neutral position) of the target steering angle is set higher the larger the inclination amount of the lever 7 from the neutral position. In regard to the inclination of the lever 7 in the rightward/leftward direction, a predetermined range near the neutral position is preferably set to a dead band. A change of steering angle that is not intended by the operator can thereby be prevented.

The second target value computing section 22 includes a target value setting unit 22A and a propulsive force allocating unit 22B. The target value setting unit 22A sets a target propulsive force, which is to act on the entirety of the marine vessel 1, a target heading direction, and a target turning speed (turning angular speed) as target values according to the operation of the lever 7 and knob 8. More specifically, the target value setting unit 22A generates the target propulsive force and the target propagation direction for making the marine vessel 1 undergo parallel movement in a direction that is in accordance with the inclination direction of the lever 7 by a propulsive force that is in accordance with the inclination amount of the lever 7. Further, the target value setting unit 22A generates the target turning speed according to the rotation operation direction and the rotation operation amount of the knob 8. The propulsive force allocating unit 22B computes, in accordance with the target values set by the target value setting unit 22A, the individual target values expressing the respective propulsive forces to be generated by the propulsion systems 10 to 12 and the directions of the propulsive forces. That is, in regard to the bow thruster 10, the propulsive force allocating unit 22B computes the target rotation direction and the target rotation speed. In regard to each of the outboard motors 11 and 12, the propulsive force allocating unit 22B computes the target shift position, the target engine speed, and the target steering angle. In this case, the target values provided to the outboard motors 11 and 12 are generally not equal to each other.

In one operation example, the switching unit 23 switches the control mode in accordance with the speed (forward drive speed and reverse drive speed) of the marine vessel 1 detected by the speed sensor 16. In another operation example, the switching unit 23 switches the control mode according to the position of the marine vessel 1 detected by the position detecting apparatus 17 and the obstacle detection result of the obstacle sensor 18. In either case, the switching unit 23 switches the control mode between the ordinary running mode, in which the computation results of the first target value computing section 21 are selected, and the parallel movement mode, in which the computation results of the second target value computing section 22 are selected. The computation results (target values) selected by the switching unit 23 are sent to the ECUs 9, 13, and 14 of the bow thruster 10, the portside outboard motor 11, and the starboard side outboard motor 12.

Figure 5A:
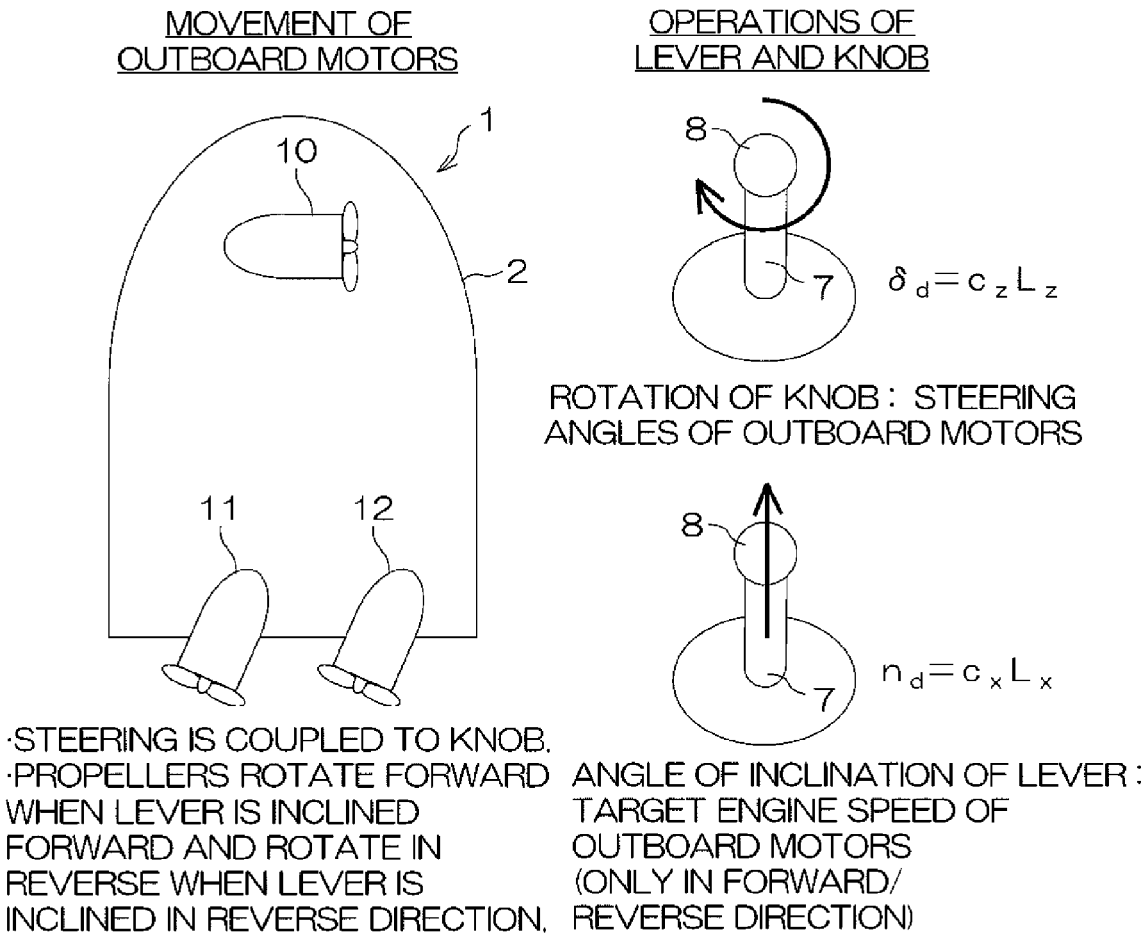
FIG. 5A is a diagram for explaining an operation example concerning a relationship between operator's operations of the lever and actions of outboard motors in an ordinary running mode.

FIG. 5A is a diagram for explaining operator's operations of the lever 7 and actions of the outboard motors 11 and 12 in the ordinary running mode. Here, the inclination amount $L_x$ in the forward/reverse direction of the lever 7 is provided with a plus sign in the case of inclination in the forward direction and with a minus sign in the case of inclination in the reverse direction. With respect to the inclination amount $L_x$ further in the forward direction beyond the forward drive shift-in position or further in the reverse direction beyond the reverse drive shift-in position, the target value setting unit 21A of the first target value computing section 21 sets the target engine speed $n_d$ by: $n_d=c_x \times L_x$. Here, the target engine speed $n_d$ is provided with a plus sign in the case of forward drive rotation and with a minus sign in the case of reverse drive rotation. In addition, $c_x$ is a coefficient (for example, a constant). Further, the target value setting unit 21A sets the target steering angle $\delta_d$ according to the rotation operation amount $L_z$ of the knob 8 and by: $\delta_d=c_z \times L_z$. Here, $c_z$ is a coefficient (for example, a constant), and, for example, the rotation operation amount $L_z$ is provided with a plus sign in the case of a rightward rotation operation and with a minus sign in the case of a leftward rotation operation. The target steering angle $\delta_d$ is thus provided with a plus sign in the case of rightward steering and a minus sign in the case of leftward steering. The lever 7 thus serves a role of a throttle lever and the knob 8 serves a role of a steering handle.

The propulsive force allocating unit 21B of the first target value computing section 21 sets the target rotation speed of the bow thruster 10 to zero and sets the engine speed $n_L$ of the portside outboard motor 11 and the target engine speed $n_R$ of the starboard side outboard motor 12 such that $n_L=n_R=n_d$. The propulsive force allocating unit 21B also sets the target steering angle $\delta_L$ of the portside outboard motor 11 and the target steering angle $\delta_R$ of the starboard side outboard motor 12 such that $\delta_L=\delta_R=\delta_d$. Thus, in the ordinary running mode, while the bow thruster 10 is put in a stopped state, the portside and starboard side outboard motors 11 and 12 generate equivalent propulsive forces in parallel directions.

FIG. 5B is a diagram for explaining another operation example. That is, another example concerning the relationship between operator's operations of the lever 7 and actions of the outboard motors 11 and 12 in the ordinary running mode is shown. The setting of the target engine speed $n_d$ is the same as in the operation example of FIG. 5A, and the target value setting unit 21A of the first target value computing section 21 sets the target engine speed $n_d$ by: $n_d=c_x \Delta L_x$ in accordance with the inclination amount $L_x$ in the forward/reverse direction of the lever 7. Meanwhile, the target steering angle $\delta_d$ is set not in accordance with the rotation operation of the knob 8 but in accordance with the inclination amount $L_y$ in the rightward/leftward direction of the lever 7. That is, the target value setting unit 21A of the first target value computing section 21 sets the target steering angle $\delta_d$ by: $\delta_d=c_y \times L_y$ in accordance with the inclination amount $L_y$ in the rightward/leftward direction of the lever 7. Here, $c_y$ is a coefficient (for example, a constant), and the inclination amount $L_y$ is provided with a plus sign in the case of a rightward inclination and with a minus sign in the case of a leftward inclination. The target steering angle $\delta_d$ is thus provided with a plus sign in the case of rightward steering and a minus sign in the case of leftward steering. The forward/reverse direction operation of the lever 7 is thus made to correspond to the operation of a throttle lever and the rightward/leftward direction operation of the lever 7 is made to correspond to the operation of a steering handle.

The actions of the propulsive force allocating unit 21B of the first target value computing section 21 are the same as in the case of the of the operation example of FIG. 5A.

FIG. 6 is a diagram for explaining operator's operations of the lever 7 and actions of the bow thruster 10 and the outboard motors 11 and 12 in the parallel movement mode (marine vessel maneuvering support mode for anchoring). In the present preferred embodiment, the steering angles of the outboard motors 11 and 12 are set to fixed values, determined in advance, in the parallel movement mode. For example, the second target value computing section 22 fixes the target steering angle $\delta_L$ of the portside outboard motor 11 to $-\pi/6$ (rad) and fixes the target steering angle $\delta_R$ of the starboard side outboard motor 12 to $\pi/6$ (rad). The steering angle $\delta_F$ (the direction of the propulsive force generated by the propeller) of the bow thruster 10 is mechanically fixed at $\pi/2$ (rad). Here, the "steering angle" is the deflection angle of the propeller rotation axial line with respect to the central line 5 (see FIG. 1) of the hull 2, with the direction from the bow to the stern being 0 degree, an angle in a leftward (counterclockwise) rotation direction with respect to 0 degree being positive, and an angle in a rightward (clockwise) rotation direction with respect to 0 degree being negative. In regard to the bow thruster 10, the propeller rotation axial line extends in the rightward direction from the propeller 10*b*, and in regard to the outboard motors 11 and 12, the propeller rotation axial lines extend to the rear of the marine vessel in directions away from the corresponding outboard motors.

The heading direction and the turning speed (angular speed) of the marine vessel 1 in the parallel movement mode are mostly adjusted by the propeller rotation directions and propeller rotation speeds (that is, the directions and the magnitudes of the propulsive forces) of the bow thruster 10 and the outboard motors 11 and 12.

The target value setting unit 22A of the second target value computing section 22 determines the forward/reverse direction target thrust (propulsive force) $F_{dx}=c_x \times L_x$ in accordance with the forward/reverse direction inclination amount $L_x$ of the lever 7. The target value setting unit 22A also determines the rightward/leftward direction target thrust (propulsive force) $F_{dy}=c_y \times L_y$ in accordance with the rightward/leftward direction inclination amount $L_y$ of the lever 7. Further, the marine vessel running controlling apparatus 20 determines the target torque $M_{dz}=c_z \times L_z$ for turning the marine vessel 1 in accordance with the rotation operation amount $L_z$ of the knob 8. However, the values of coefficients $c_x$, $c_y$, $c_z$ are different from those for the ordinary running mode. Based on these target values $F_{dx}$, $F_{dy}$, and $M_{dz}$, the individual propulsive forces that are to be generated by the bow thruster 10 and the outboard motors 11 and 12 are determined by the propulsive force allocating unit 22B.

Figure 7:
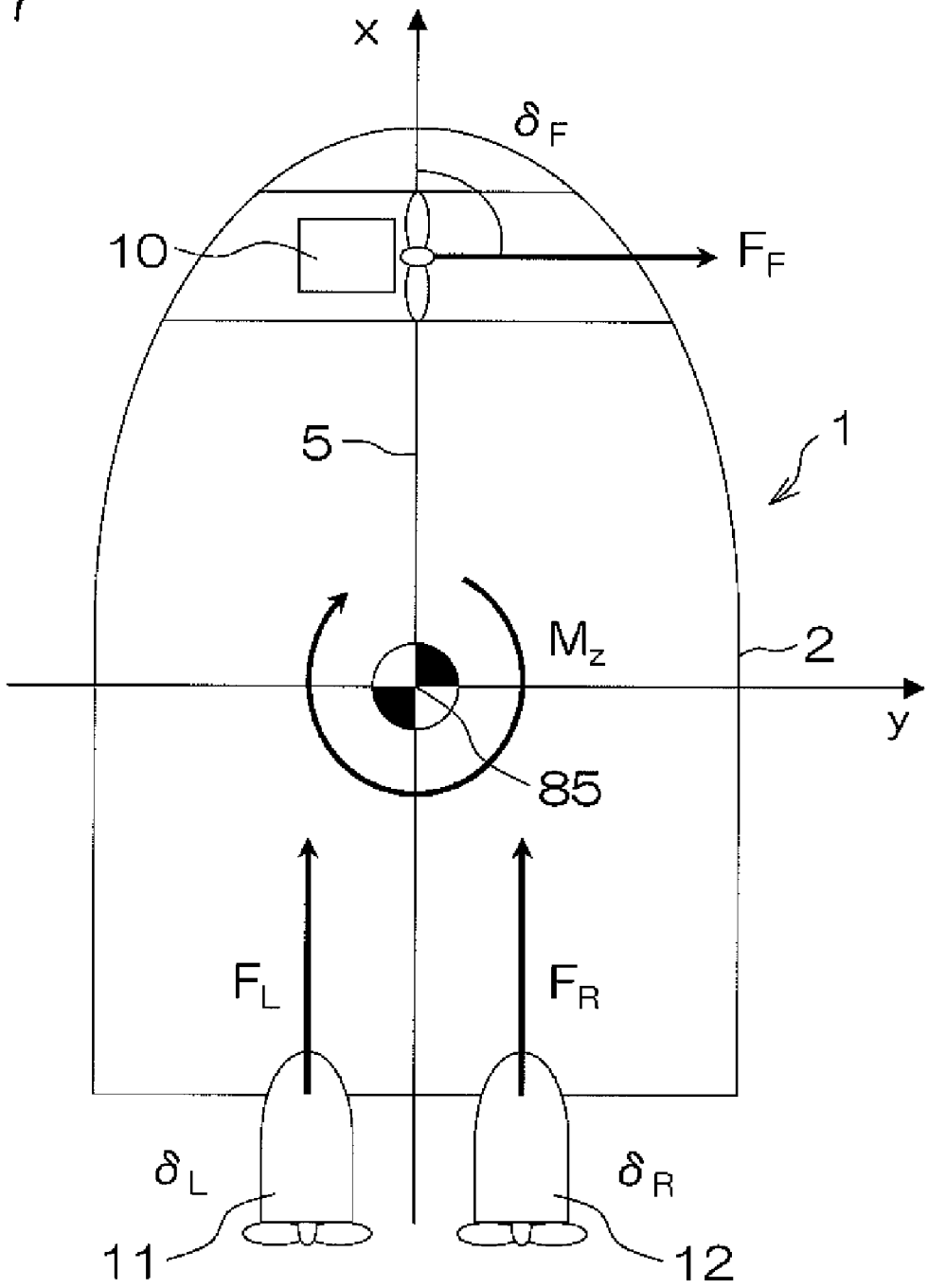
FIG. 7 is a diagram of a hull coordinate system.

The actions of the propulsive force allocating unit 22B is now to be explained in more detail. For the explanation, the following symbols are introduced:

$F_F$: thrust output by the bow thruster $F_L$: thrust output by the portside outboard motor $F_R$: thrust output by the starboard side outboard motor $(x_F, y_F)$: position of the bow thruster in a hull coordinate system $(x_L, y_L)$: position of the port side outboard motor in the hull coordinate system $(x_R, y_R)$: position of the starboard side outboard motor in the hull coordinate system $\delta_F$: target steering angle of the bow thruster $\delta_L$: target steering angle of the portside outboard motor $\delta_R$: target steering angle of the starboard side outboard motor The "hull coordinate system" is a coordinate system with an origin set at an instantaneous rotation center 80 of the marine vessel 1, an x-axis taken along the central line 5, and a y-axis taken along a horizontal direction (rightward/leftward direction) orthogonal to the x-axis as shown in FIG. 7.

When the propulsive force and moment for control are expressed as $\tau=[F_{dx}\ F_{dy}\ M_{dz}]^T$ (where T indicates transposition of a matrix or vector) and the propulsive forces to be output by the respective propulsion systems 10, 11 and 12 are expressed as $f=[F_F\ F_L\ F_R]^T$, f is calculated using the following control allocation matrix $T(\delta)$:

$$f=T(\delta)^{-1}\tau \tag{1}$$

The control allocation matrix $T(\delta)$ is expressed as follows:

$$T(\delta)=[T_F\ T_L\ T_R] \tag{2}$$

$$T_F=[\cos\delta_F\ \sin\delta_F\ x_F\sin\delta_F-y_F\cos\delta_F]^T \tag{3}$$

$$T_L=[\cos\delta_L\ \sin\delta_L x_L\sin\delta_L-y_L\cos\delta_L]^T \tag{4}$$

$$T_R=[\cos\delta_R\ \sin\delta_R x_R\sin\delta_R-y_R\cos\delta_R]^T \tag{5}$$

As mentioned above, in the present preferred embodiment, $\delta_F=\pi/2$ (rad), $\delta_L=-\pi/6$ (rad), and $\delta_R=\pi/6$ (rad). These settings are merely exemplary and, in general, the settings may be determined such that $T(\delta)$ has an inverse matrix $T(\delta)^{-1}$ and there is no need to use fixed values.

The target thrust $F_d=f$ and the target steering angles $\delta_d=[\delta_F\delta_L\ \delta_R]^T$ are thus determined by the propulsive force allocating unit 22B. Further, the propulsive force allocating unit 22B determines the target rotation speed $n_F$ of the bow thruster 10 and the target engine speeds $n_L$ and $n_R$ of the outboard motors 11 and 12 from the target thrust $F_d$. The sign of the target rotation speed $n_F$ expresses the target rotation direction of the electric motor 10*a* of the bow thruster 10. The signs of the target engine speeds $n_L$ and $n_R$ express the target shift positions of the outboard motors 11 and 12. The target values, $n_F$, $n_L$, $n_R$, $\delta_F$, $\delta_L$, and $\delta_R$ thus determined are allocated to the ECUs 9, 13, and 14 of the corresponding propulsion systems 10, 11, and 12.

The thrust T generated by a propeller is obtained by the following formula:

$$T=\rho D^4 K_T(J)n|n| \tag{6}$$

In the above, ρ is the density of water, D is a propeller diameter, n is a propeller rotation speed, and J is an advance ratio that is given by the following formula:

$$J=u/(nD) \tag{7}$$

u is a speed of a propeller wake flow (speed of the marine vessel; this can be regarded as being virtually zero in the case of the bow thruster 10). $K_T$ is a thrust coefficient, which is a function of the advance ratio J and is determined by actual measurement or simulation. Thus, if the current speed of the propeller wake flow and the propeller rotation speed are known, the currently generated thrust and torque can be obtained.

The propulsive force allocating unit 22B of the second target value computing section 22 includes a map 22*m* (see FIG. 4). The map 22*m* stores the thrust coefficient $K_T(J)$ corresponding to various values of the speed of the marine vessel 1 and the propeller rotation speeds for each of the bow thruster 10 and the outboard motors 11 and 12.

The propulsive force allocating unit 22B determines the thrust coefficient $K_T$ by referencing the map 22*m* using the speed of the marine vessel 1 detected by the speed sensor 16, the current propeller rotation speed provided from the ECU 9, and the current engine speeds provided from the ECUs 13 and 14. The propulsive force allocating unit 22B further uses the thrust coefficient $K_T$ to determine the target rotation speeds $n_F$, $n_L$, and $n_R$ of the respective propulsion systems 10 to 12 corresponding to the target thrust $F_d$ from Formula (6).

The ECU 9 of the bow thruster 10 executes feedback control (for example, PID (proportional integral differential) control) of the electric motor 10*a* such that the propeller rotation speed (rotation speed of the electric motor) matches the target rotation speed $n_F$. The ECUs 13 and 14 of the outboard motors 11 and 12 perform feedback control (for example, PID control) of the throttle actuators 51 such that the propeller rotation speeds (engine speeds) match the target rotation speeds $n_L$ and $n_R$.

Figure 8:
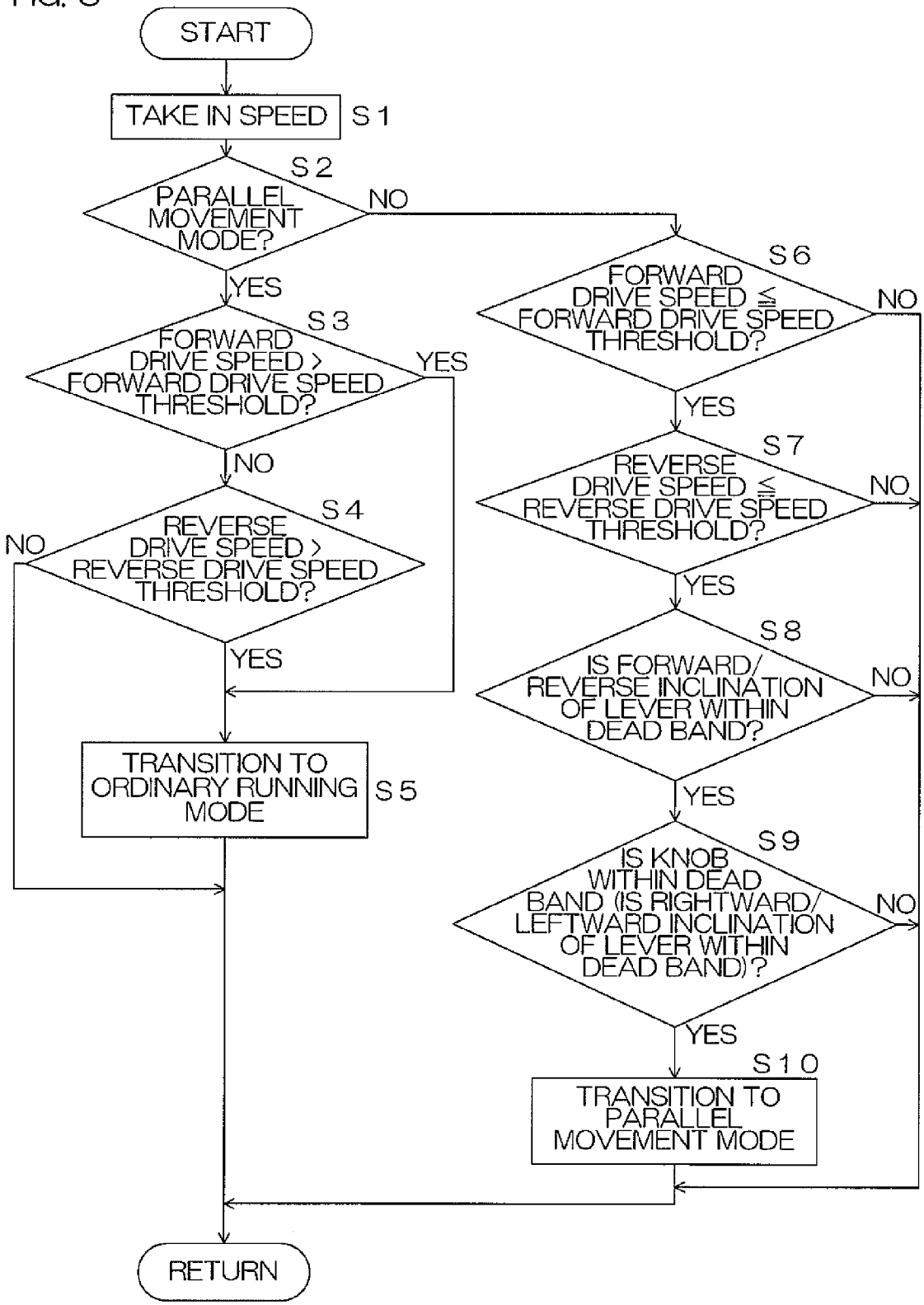
FIG. 8 is a flowchart for explaining switching of a control mode according to a speed of the marine vessel.

FIG. 8 is a flowchart for explaining the switching of the control mode (action of the switching unit 23) according to the speed of the marine vessel 1. The initial control mode is set to the parallel movement mode. That is, the switching unit 23 selects the target values computed by the second target value computing section 22 and provides the selected values to the propulsion systems 10 to 12.

The marine vessel running controlling apparatus 20 takes in the speed of the marine vessel 1 detected by the speed sensor 16 (step S1).

In the parallel movement mode (step S2: YES), the marine vessel running controlling apparatus 20 judges whether or not the forward drive speed (absolute value of the speed in the forward drive direction) exceeds a predetermined forward drive speed threshold (for example, 4 km/h) (step S3). The marine vessel running controlling apparatus 20 also judges whether or not the reverse drive speed (absolute value of the speed in the reverse drive direction) exceeds a predetermined reverse drive speed threshold (for example, 2 km/h) (step S4). If the forward drive speed exceeds the forward drive speed threshold (step S3: YES), the marine vessel running controlling apparatus 20 changes the control mode from the parallel movement mode to the ordinary running mode (step S5). That is, the switching unit 23 selects the target values computed by the first target value computing section 21 and provides the selected values to the propulsion systems 10 to 12. If the reverse drive speed exceeds the reverse drive speed threshold (step S4: YES), the marine vessel running controlling apparatus 20 likewise changes the control mode from the parallel movement mode to the ordinary running mode. If the forward drive speed is not more than the forward drive speed threshold (step S3: NO) and the reverse drive speed is not more than the reverse drive speed threshold (step S4: NO), the marine vessel running controlling apparatus 20 keeps the control mode in the parallel movement mode.

By such a process, transition to the ordinary running mode is performed automatically when the speed of the marine vessel 1 becomes high. Thus, when a crowded water area near a pier is departed from and the speed is raised, switching from the parallel movement mode to the ordinary running mode is performed automatically without requiring any special operation. Operation is thus made easy.

On the other hand, in the ordinary running mode (step S2: NO), the marine vessel running controlling apparatus 20 judges whether or not the forward drive speed is equal to or less than a predetermined forward drive speed threshold (for example, 3 km/h) (step S6). The marine vessel running controlling apparatus 20 also judges whether or not the reverse drive speed is equal to or less than a predetermined reverse drive speed (for example, 1 km/h) (step S7). Although the forward drive speed threshold and the reverse drive speed threshold here may be set equivalent to the values applied in the parallel movement mode, these are set to different values (smaller values to be specific) in the present preferred embodiment. A hysteresis is thus applied to the transition of the control mode to stabilize control.

Further, the marine vessel running controlling apparatus 20 judges whether or not the inclination amount in the forward/reverse direction of the lever 7 is within a predetermined dead band (step S8). In this case, the dead band signifies a range in which the propulsive forces are not generated from the outboard motors 11 and 12 in the ordinary running mode, that is, a range between the forward drive shift-in position and the reverse shift-in position. The marine vessel running controlling apparatus 20 also judges whether or not the rotation operation amount of the knob 8 is within a predetermined dead band (step S9). In this case, the dead band is a range of so-called play in the vicinity of the neutral state and is a predetermined operation angle range in which the rotation operation of the knob 8 is not reflected in changes of the steering angles of the outboard motors 11 and 12.

When affirmative judgments are made in all of steps S6 to S9, the marine vessel running controlling apparatus 20 changes the control mode from the ordinary running mode to the parallel movement mode to (step S10). If a negative judgment is made in any one of steps S6 to S9, the marine vessel running controlling apparatus 20 keeps the control mode in the ordinary running mode.

By performing of the above process, when the speed of the marine vessel 1 is adequately low and the lever 7 and the knob 8 are practically not being operated, the control mode transitions from the ordinary running mode to the parallel movement mode. The transition of the control mode is performed automatically and does not require operation by the operator. The operation is thus made easy. The transition from the ordinary running mode to the parallel movement mode occurs as the speed is reduced in approaching a water area near a pier, and an appropriate control mode is thus selected automatically. Further, sudden change of the propulsive forces and steering angles can be avoided because the control mode switches when the operation positions of the lever 7 and the knob 8 are within the dead bands. As a result, an uncomfortable feeling felt by the operator or other passenger is thus prevented.

Although the forward drive speed threshold and the reverse drive speed threshold may be equal in value, it is preferable to set the forward drive speed threshold greater than the reverse drive speed threshold. The resistance received during running of the marine vessel 1 is relatively small during forward drive and is relatively large during reverse drive. Thus, by setting the reverse drive speed threshold to be lower than the forward drive speed threshold, the switching of the control mode can be made to occur at an equivalent operational input during forward drive and reverse drive. An uncomfortable feeling is thereby prevented.

In the case of performing the steering operation not by the knob 8 but by the rightward/leftward inclination of the lever 7 (see FIG. 5B), the marine vessel running controlling apparatus 20 judges whether or not the inclination amount in the rightward/leftward direction of the lever 7 is within a predetermined dead band in step S9. The judgment in step S9 is thus a judgment of whether or not the steering angles of the outboard motors 11 and 12 are at the neutral positions.

Figure 9:
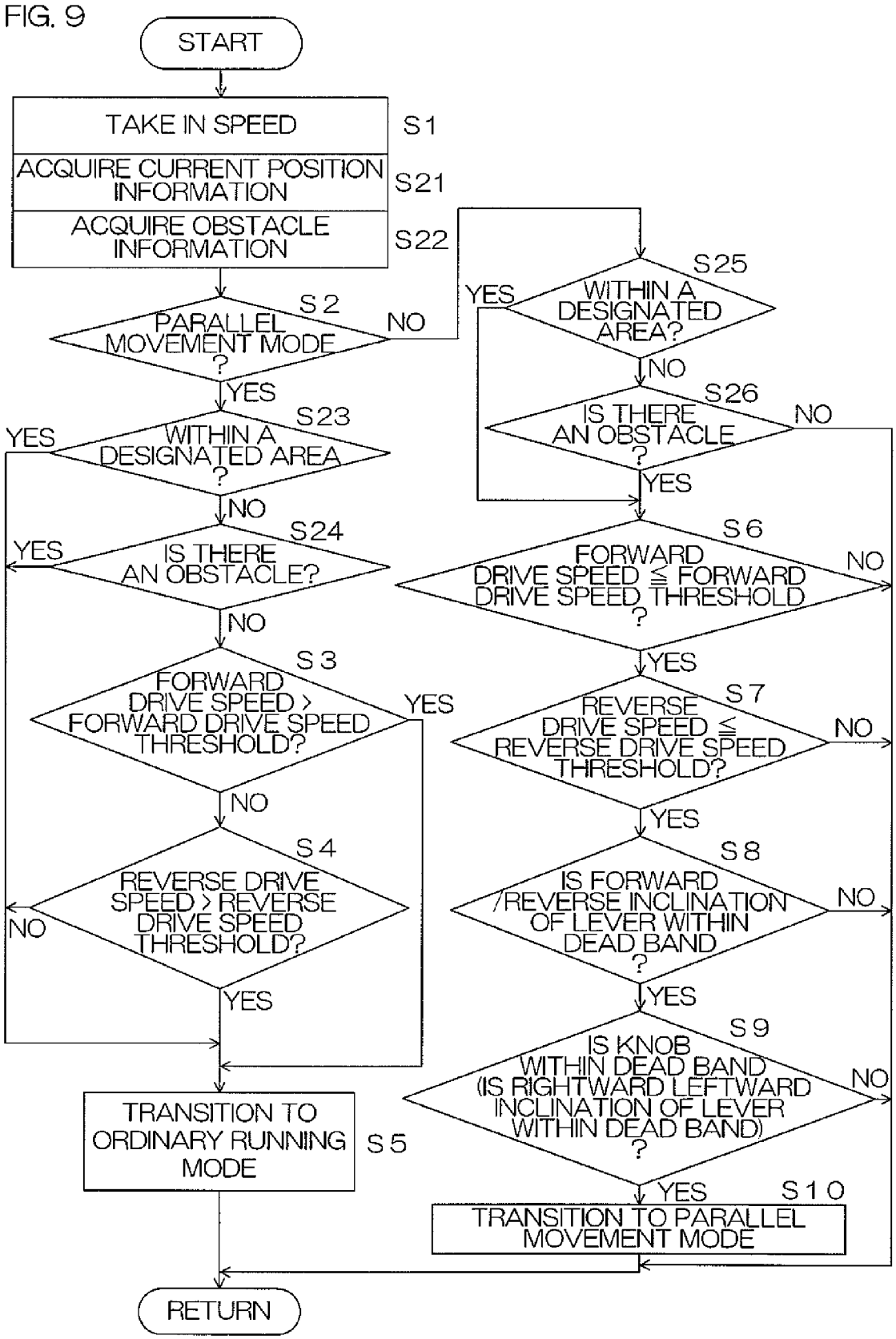
FIG. 9 is a flowchart for explaining a process of switching the control mode according to a current position of the marine vessel and presence or non-presence of an obstacle in the surroundings of the marine vessel in addition to the speed of the marine vessel.

FIG. 9 is a flowchart for explaining a process of switching the control mode (action of the switching unit 23) according to the current position of the marine vessel and the presence or non-presence of an obstacle in the surroundings of the marine vessel in addition to the speed of the marine vessel. In FIG. 9, steps in which processes equivalent to those of the respective steps shown in FIG. 8 are performed are provided with the same symbols.

The initial control mode is set to the parallel movement mode.

The marine vessel running controlling apparatus 20 acquires the speed of the marine vessel 1 detected by the speed sensor 16, the current position of the marine vessel 1 detected by the position detecting apparatus 17, and the detection result (obstacle information) from the obstacle sensor 18 (steps S1, S21, S22).

In the parallel movement mode (step S2: YES), the marine vessel running controlling apparatus 20 judges, based on the current position information, whether or not the marine vessel 1 is positioned inside a designated area (step S23). A designated area is a region that is set in advance as an area in which the parallel movement mode is appropriate (for example, a water area in the vicinity of a pier) The marine vessel running controlling apparatus 20 includes, for example, a recording medium in which a map database, including topographical information, is recorded, and predetermined areas are registered as designated areas in advance in the map database. The marine vessel running controlling apparatus 20 references the map database to judge whether or not the current position information indicates a position within a designated area. If the current position information indicates that the current position is inside a designated area (step S23: YES), the marine vessel running controlling apparatus 20 keeps the control mode in the parallel movement mode. Further, the marine vessel running controlling apparatus 20 references the obstacle information and judges whether or not an obstacle exists in the surroundings of the marine vessel 1 (step S24). More specifically, in the case where the distances to obstacles in the surroundings are detected by the obstacle sensor 18, it is judged whether or not the distance to the closest obstacle is equal to or less than a predetermined value. If an affirmative judgment is made, the marine vessel running controlling apparatus 20 keeps the control mode in the parallel movement mode.

By such a process, the control mode is kept in the parallel movement mode when the current position is inside a designated area or when there is an obstacle nearby.

If the current position is not inside a designated area (step S23: NO) and an obstacle does not exist in the surrounding areas (step S24: NO), a judgment concerning the speed of the marine vessel 1 is made. That is, the marine vessel running controlling apparatus 20 judges whether or not the forward drive speed exceeds the forward drive speed threshold (for example, about 4 km/h) (step S3). The marine vessel running controlling apparatus 20 also judges whether or not the reverse drive speed exceeds the reverse drive speed threshold (for example, about 2 km/h) (step S4). If the forward drive speed exceeds the forward drive speed threshold (step S3: YES), the marine vessel running controlling apparatus 20 changes the control mode from the parallel movement mode to the ordinary running mode (step S5). If the reverse drive speed exceeds the reverse drive speed threshold (step S4: YES), the marine vessel running controlling apparatus 20 likewise changes the control mode from the parallel movement mode to the ordinary running mode. If the forward drive speed is not more than the forward drive speed threshold (step S3: NO) and the reverse drive speed is not more than the reverse drive speed threshold (step S4: NO), the marine vessel running controlling apparatus 20 keeps the control mode in the parallel movement mode.

By such a process, the transition to the ordinary running mode is performed automatically when the speed of the marine vessel 1 becomes high under the conditions that the current position is outside a designated area and no obstacles exist nearby. Automatic switching from the parallel movement mode to the ordinary running mode can thus be performed appropriately.

On the other hand, in the ordinary running mode (step S2: NO), the marine vessel running controlling apparatus 20 judges, based on the current position information of the marine vessel 1, whether or not the marine vessel 1 is positioned inside a designated area (step S25). Further, the marine vessel running controlling apparatus 20 judges, based on the obstacle information, whether or not an obstacle exists in the surroundings of the marine vessel 1 (step S26). If the current position is not within a designated area (step S25: NO) and there are no obstacles in the surrounding areas (step S26: NO), the marine vessel running controlling apparatus 20 keeps the control mode in the ordinary running mode.

By performing of such a process, the control mode can be kept appropriately in the ordinary running mode based on the current position of the marine vessel 1 and the presence or non-presence of an obstacle in the surroundings.

If the current position is within a designated area (step S25: YES) or an obstacle exists in the surroundings (step S26 YES), a judgment concerning the speed of the marine vessel 1 is made. That is, the marine vessel running controlling apparatus 20 judges whether or not the forward drive speed is equal to or less than the predetermined forward drive speed threshold (for example, about 3 km/h) (step S6). The marine vessel running controlling apparatus 20 also judges whether or not the reverse drive speed is equal to or less than the predetermined reverse drive speed (for example, about 1 km/h) (step S7). Further, the marine vessel running controlling apparatus 20 judges whether or not the inclination amount in the forward/reverse direction of the lever 7 is within the predetermined dead band (step S8). The marine vessel running controlling apparatus 20 also judges whether or not the rotation operation amount of the knob 8 (or the inclination amount of the lever 7 in the rightward/leftward direction) is within the predetermined dead band (step S9).

When affirmative judgments are made in all of steps S6 to S9, the marine vessel running controlling apparatus 20 changes the control mode from the ordinary running mode to the parallel movement mode (step S10). If a negative judgment is made in any one of steps S6 to S9, the marine vessel running controlling apparatus 20 keeps the control mode in the ordinary running mode.

By performing such a process, under circumstances where the current position is within a designated area or an obstacle exists in the surroundings, the control mode transitions from the ordinary running mode to the parallel movement mode automatically under fixed conditions. Selection of the control mode according to the state of the marine vessel 1 can thereby be performed more appropriately.

As described above, with the present preferred embodiment, the lever 7 and the knob 8 can be used in common in both the ordinary running mode and the parallel movement mode. The operator thus does not have to exchange operational systems in accordance with the control mode. Operations during departure from port and return to port can thereby be performed easily. Moreover, the switching of the control mode is performed automatically according to the speed, current position, and circumstances of obstacles in the surroundings of the marine vessel 1. Marine vessel maneuvering can thus be performed even more readily. Further, an operational system can be shared for the ordinary running mode and the parallel movement mode, thereby enabling the configuration of the entire operational system to be simplified and the cost to be reduced and the installation space of the operational system to be reduced accordingly.

Figure 10:
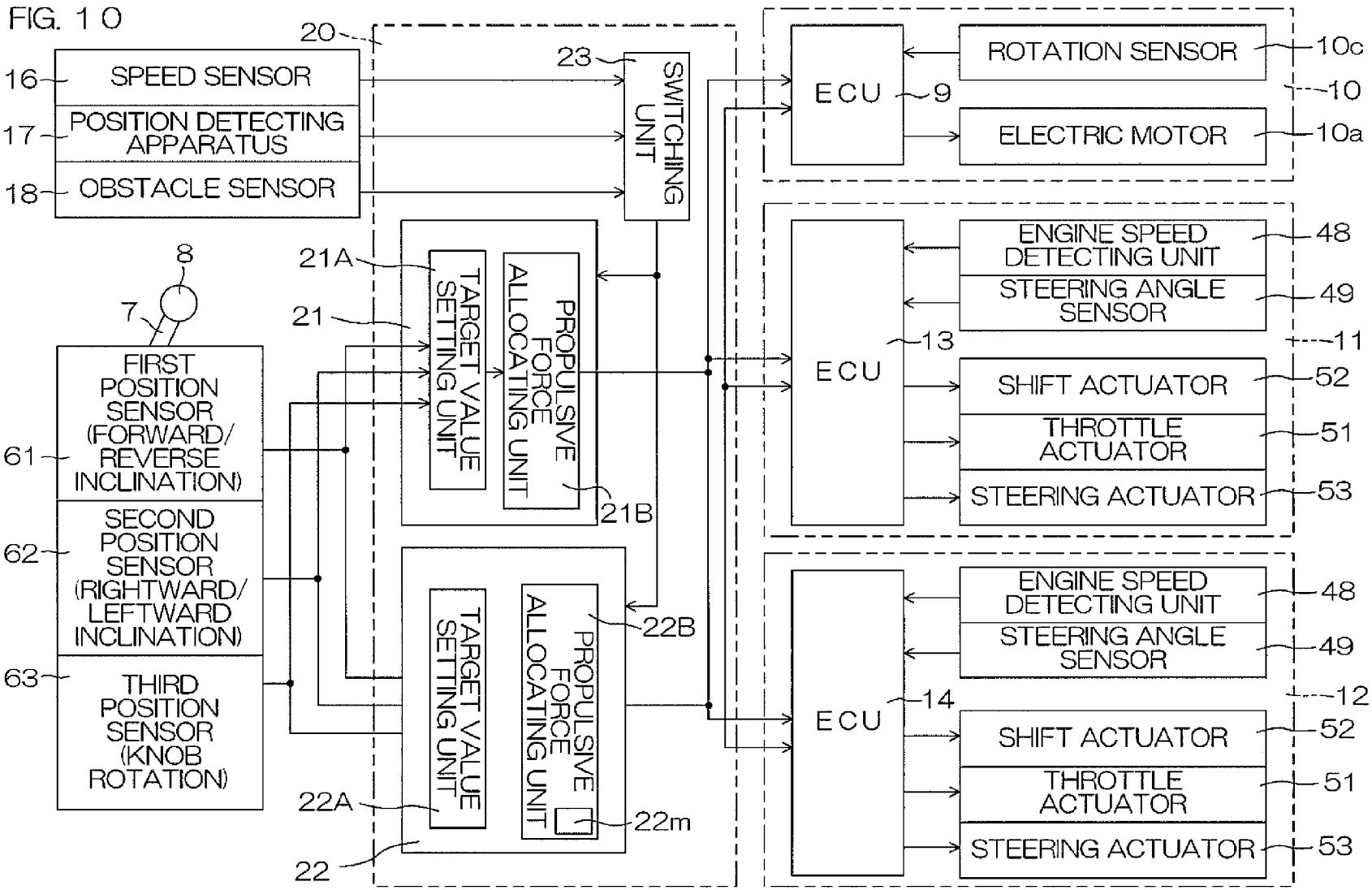
FIG. 10 is a block diagram of an electrical configuration of principal portions of a marine vessel according to another preferred embodiment of the present invention.

FIG. 10 is a block diagram of an electrical configuration of principal portions of a marine vessel according to another preferred embodiment of the present invention. In FIG. 10, portions equivalent to the respective portions shown in FIG. 4 described above are provided with the same reference symbols. In the preferred embodiment described above, the switching unit 23 which switches the control mode is configured to select the computation results (target values) of either of the first and second target value computing sections 21 and 22, and supply the computation results to the propulsion systems 10 to 12. On the other hand, with the present preferred embodiment, the switching unit 23 activates one of either of the first and second target value computing sections 21 and 22, and puts the other unit in a non-activated state. The target values generated by one of the target value computing section 21 and 22 that is in the activated state are supplied to the propulsion systems 10 to 12. The same actions and advantages as those of the first preferred embodiment described above can be achieved with this configuration as well.

While the preferred embodiments of the present invention have thus been described, the present invention may be embodied in other ways. For example, although in the preferred embodiments described above, the target rotation speed of the electric motor or the engine is preferably computed as the target value related to the output of the propulsion system, a target throttle opening, a target thrust, a target speed, etc., may be used instead. Also, although in the preferred embodiments described above, the target steering angle is computed as the target value related to the turning of the marine vessel, a target yaw angular speed may be used instead.

Also, in the processes shown in FIGS. 8 and 9, the judgment using the speed of the marine vessel 1 may be replaced by a judgment using the engine speeds of the outboard motors 11 and 12. Specifically, in the parallel movement mode, the control mode can be changed to the ordinary running mode under the condition that the engine speeds exceed a predetermined threshold. Further, in the ordinary running mode, the condition that the engine speeds are not more than the threshold can be used as the condition for transition to the parallel movement mode.

Also, although with the preferred embodiments described above, the control mode is preferably switched automatically, a mode switching operation unit (for example, a mode switching button) for performing the switching of the control mode manually may be provided. An operational system in common is used for the ordinary running mode and the parallel movement mode in this case as well, and the trouble accompanying the exchange of operational systems can thus be avoided.

Also, although in the process shown in FIG. 9, both the current position information and the obstacle information are used, just one of them may be used instead.

Further, in the processes of FIGS. 8 and 9, the judgment of whether or not the operation positions of the lever 7, etc., are within dead bands is not made in the transition from the parallel movement mode to the ordinary running mode. However, in the case in which the rightward/leftward inclination of the lever 7 is associated with the control of the steering angle in the ordinary running mode, it is preferable to add a condition concerning the operation of the lever 7. That is, when the transition to the ordinary running mode occurs while parallel movement is being performed toward an oblique direction in the parallel movement mode, the marine vessel 2 will start to turn and this may cause an uncomfortable feeling in the passenger. It is thus preferable to add the condition that the inclination amount in the rightward/leftward direction of the lever 7 is within a minute angular range (dead band) as a condition for the transition to the ordinary running mode.

Also, an indicator (for example, an indicator lamp) that displays whether the current control mode is the ordinary running mode or the parallel movement mode may be provided. Such an indicator may be disposed on the control console 6.

Further, although with the preferred embodiments described above, the bow thruster 10 and the outboard motors 11 and 12 are preferably provided as the propulsion systems, the bow thruster 10 does not necessarily have to be provided. That is, marine vessel maneuvering in the parallel movement mode may be realized by making use of a balance of the propulsive forces generated by the pair of outboard motors 11 and 12.

It is possible to apply various design changes besides the above within a scope of the claims.

The correspondence between the terms used in the "SUMMARY OF THE INVENTION" section and the terms used in the above description of the preferred embodiments is shown below as a non-limiting example:

propulsion system: bow thruster 10, outboard motors 11 and 12
steering mechanism: steering mechanism 50
marine vessel: marine vessel 1
operational unit: lever 7, knob 8
target value computing unit: first and second target value computing sections 21 and 22
switching unit: switching unit 23
control unit: ECUs 9, 13, and 14
selection output unit: switching unit 23 (FIG. 4)
selecting and activating unit: switching unit 23 (FIG. 10)
parallel mode: ordinary running mode
non-parallel mode: parallel movement mode
obstacle sensor: obstacle sensor 18
obstacle judging unit: steps S24 and S26 (FIG. 9)
lever: lever 7
rotation operational section, rotation operational element: knob 8
input detecting unit: first to third position sensors 61 to 63
inclination detecting unit: first and second position sensors 61 and 62
rotation detecting unit: third position sensor 63
first mode: ordinary running mode
second mode: parallel movement mode
hull: hull 2
marine vessel maneuvering supporting apparatus: lever 7, knob 8,
marine vessel running controlling apparatus 20

While the present invention has been described in detail by way of the preferred embodiments thereof, it should be understood that these preferred embodiments are merely illustrative of the technical principles of the present invention but not limitative of the present invention. The spirit and scope of the present invention are to be limited only by the appended claims.

This application corresponds to Japanese Patent Application No. 2008-305123 filed in the Japanese Patent Office on Nov. 28, 2008, the disclosure of which is incorporated herein by reference.

What is claimed is:

1. A marine vessel maneuvering supporting apparatus for a marine vessel which includes a propulsion system and a steering mechanism, the marine vessel maneuvering supporting apparatus comprising:

an operational unit arranged to be operated by an operator and to control movement and turning of the marine vessel;

a target value computing unit, having a plurality of computing modes, arranged to compute target values including a target propulsive force for the propulsion system and a target steering angle for the steering mechanism, in accordance with an operational input from the operational unit; and a switching unit arranged to switch the computing modes of the target value computing unit.

2. The marine vessel maneuvering supporting apparatus according to claim 1, wherein the marine vessel maneuvering supporting apparatus is adapted to be installed in a marine vessel which includes a plurality of the propulsion systems and a plurality of the steering mechanisms respectively corresponding to the plurality of propulsion systems, and the plurality of computing modes includes a parallel mode in which the steering angles of the plurality of propulsion systems are set to be parallel or substantially parallel, and a non-parallel mode in which the steering angles of the propulsion systems are set to be non-parallel.

3. The marine vessel maneuvering supporting apparatus according to claim 1, wherein the switching unit is arranged to switch the computing mode of the target value computing unit according to a state of the marine vessel.

4. The marine vessel maneuvering supporting apparatus according to claim 3, wherein the state of the marine vessel includes at least one of either an operation state of the marine vessel or an environment surrounding the marine vessel.

5. The marine vessel maneuvering supporting apparatus according to claim 3, wherein the state of the marine vessel includes a speed of the marine vessel, and the switching unit is arranged to switch the computing mode of the target value computing unit according to the speed of the marine vessel.

6. The marine vessel maneuvering supporting apparatus according to claim 3, wherein the state of the marine vessel includes at least one of either position information of the marine vessel or obstacle information concerning presence or non-presence of an obstacle in an area surrounding the marine vessel.

7. The marine vessel maneuvering supporting apparatus according to claim 3, further comprising an obstacle determining unit arranged to receive a detection signal from an obstacle sensor that detects the presence or non-presence of an obstacle in an area surrounding the marine vessel and thereby to determine the presence or non-presence of the obstacle in the surroundings of the marine vessel, wherein the switching unit is arranged to switch the computing mode of the target value computing unit according to the determination result of the obstacle determining unit.

8. The marine vessel maneuvering supporting apparatus according to claim 1, wherein the operational unit includes an inclinable lever and an input detecting unit having an inclination detecting unit that detects an inclination of the lever.

9. The marine vessel maneuvering supporting apparatus according to claim 8, wherein the lever is capable of inclination in forward and reverse directions, the operational unit further includes a rotatable rotation operational section, and the input detecting unit further includes a rotation detecting unit that detects a rotation operation of the rotation operational section.

10. The marine vessel maneuvering supporting apparatus according to claim 9, wherein the plurality of computing modes includes a first mode in which the target values are computed with the inclination operation of the lever being associated with adjustment of the propulsion system output and the rotation operation of the rotation operational section being associated with adjustment of the steering angle of the steering mechanism, and a second mode in which the target values are computed with the inclination direction of the lever being associated with adjustment of a heading direction of the marine vessel and the rotation operation of the rotation operational section being associated with adjustment of turning of the marine vessel.

11. The marine vessel maneuvering supporting apparatus according to claim 8, wherein the lever is arranged to be inclined in forward and reverse directions as well as in rightward and leftward directions, and the computing modes include a first mode in which the target values are computed with the forward/reverse direction inclination operation of the lever being associated with adjustment of the propulsion system output and the rightward/leftward direction inclination operation of the lever being associated with adjustment of the steering angle of the steering mechanism, and a second mode in which the target values are computed with the inclination direction of the lever being associated with adjustment of the heading direction of the marine vessel.

12. The marine vessel maneuvering supporting apparatus according to claim 1, wherein the switching unit is arranged to switch the computing mode under a condition that an operational input from the operational unit is not being made.

13. A marine vessel comprising:

a hull;

a propulsion system and a steering mechanism attached to the hull; and a marine vessel maneuvering supporting apparatus arranged to compute target values for the propulsion system and the steering mechanism, the marine vessel maneuvering supporting apparatus including:

an operational unit arranged to be operated by an operator and to control movement and turning of the marine vessel;

a target value computing unit, having a plurality of computing modes, arranged to compute target values including a target propulsive force for the propulsion system and a target steering angle for the steering mechanism, in accordance with an operational input from the operational unit; and a switching unit arranged to switch the computing modes of the target value computing unit.

14. The marine vessel according to claim 13, further comprising a plurality of the propulsion systems and a plurality of the steering mechanisms respectively corresponding to the plurality of propulsion systems, wherein the plurality of computing modes includes a parallel mode in which the steering angles of the plurality of propulsion systems are set to be parallel or substantially parallel, and a non-parallel mode in which the steering angles of the propulsion systems are set to be non-parallel.

15. The marine vessel according to claim 13, wherein the switching unit is arranged to switch the computing mode of the target value computing unit according to a state of the marine vessel.

16. The marine vessel according to claim 15, wherein the state of the marine vessel includes at least one of either an operation state of the marine vessel or an environment surrounding the marine vessel.

17. The marine vessel according to claim 15, wherein the state of the marine vessel includes a speed of the marine vessel, and the switching unit is arranged to switch the computing mode of the target value computing unit according to the speed of the marine vessel.

18. The marine vessel according to claim 15, wherein the state of the marine vessel includes at least one of either position information of the marine vessel or obstacle information concerning presence or non-presence of an obstacle in an area surrounding the marine vessel.

19. The marine vessel according to claim 13, wherein the switching unit is arranged to switch the computing mode under a condition that an operational input from the operational unit is not being made.

* * * * *